US010801219B2

(12) United States Patent
Parker

(10) Patent No.: US 10,801,219 B2
(45) Date of Patent: Oct. 13, 2020

(54) WORK SCAFFOLD AND METHOD

(71) Applicant: Thomas W. Parker, Jamestown, PA (US)

(72) Inventor: Thomas W. Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 131 days.

(21) Appl. No.: 16/001,624

(22) Filed: Jun. 6, 2018

(65) Prior Publication Data

US 2018/0363307 A1 Dec. 20, 2018

Related U.S. Application Data

(60) Provisional application No. 62/521,843, filed on Jun. 19, 2017.

(51) Int. Cl.

| | |
|---|---|
| ***E04G 1/28*** | (2006.01) |
| ***E04G 1/15*** | (2006.01) |
| ***E04G 1/30*** | (2006.01) |
| ***E04G 1/34*** | (2006.01) |
| *E04G 7/04* | (2006.01) |

(52) U.S. Cl.

CPC ..... *E04G 1/154* (2013.01); *E04G 1/28* (2013.01); *E04G 1/30* (2013.01); *E04G 1/34* (2013.01); *E04G 7/04* (2013.01); *E04G 2001/157* (2013.01); *E04G 2001/305* (2013.01)

(58) Field of Classification Search

CPC .... E04G 1/28; E04G 1/34; E04G 1/32; E04G 1/30

See application file for complete search history.

(56) References Cited

U.S. PATENT DOCUMENTS

| | | | | |
|---|---|---|---|---|
| 9,752,334 | B2 * | 9/2017 | Foley | E04G 1/34 |
| 2004/0238280 | A1 * | 12/2004 | Gibson | E04G 1/34 182/153 |
| 2017/0275899 | A1 * | 9/2017 | Woodward | E04G 1/34 |
| 2018/0171648 | A1 * | 6/2018 | Woodward | E04G 1/32 |

FOREIGN PATENT DOCUMENTS

| | | | | |
|---|---|---|---|---|
| FR | 2890677 | A1 * | 3/2007 | E04G 1/34 |
| FR | 2975116 | A1 * | 11/2012 | E04G 1/30 |
| WO | WO-2007132148 | A2 * | 11/2007 | E04G 1/34 |

* cited by examiner

*Primary Examiner* — Alvin C Chin-Shue
(74) *Attorney, Agent, or Firm* — Ansel M. Schwartz

(57) ABSTRACT

A work scaffold having a platform and leg assemblies rotatably attached to each end of the platform. The platform may have a handle connected to free end that extends out the sides of the platform, which engage with links attached to the leg assemblies and the platform to lock the scaffold in an open or closed position. The platform may have hooks that extend out beyond the ends of the platform from under the platform so a second work scaffold can be situated on the hooks. The platform may be formed of boards with holes that receive cross members. A method for using a work scaffold. A method for forming a work scaffold.

4 Claims, 23 Drawing Sheets

WORK SCAFFOLD AND METHOD

CROSS-REFERENCE TO RELATED APPLICATIONS

This is a non-provisional of U.S. provisional application Ser. No. 62/521,843 filed Jun. 19, 2017, incorporated by reference herein.

FIELD OF THE INVENTION

The present invention pertains to a work scaffold having a platform with leg assemblies rotatably attached in proximity to the ends of the platform. (As used herein, references to the "present invention" or "invention" relate to exemplary embodiments and not necessarily to every embodiment encompassed by the appended claims.) More specifically, the present invention pertains to a work scaffold having a platform with leg assemblies rotatably attached in proximity to the ends of the platform and a handle used for locking or unlocking the scaffold between an open or folded position, or hooks that extend from the platform for attaching another platform or a platform formed with cross members inserted through holes in boards.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Work scaffolds are transported in a folded position to a desired location, where they are then placed in an open position for users to climb upon platforms of the scaffolds to work. What is needed is a simple and secure technique for a user to lock the scaffold in the open position or to unlock the scaffold to place it in a folded position.

In addition, it is desirable to connect two or more scaffolds in the open position in series to provide an even longer platform upon which a user can work. What is needed is a simple and secure technique for two or more work scaffolds to be connected together so a user can walk between the platforms of the scaffolds when they are in the open position.

Work scaffolds are typically formed by combining boards and cross members. What is needed is a technique to combine the boards and cross members together in an efficient and secure manner.

BRIEF SUMMARY OF THE INVENTION

The present invention pertains to a work scaffold. The work scaffold comprises a platform. The work scaffold comprises a first leg assembly rotatably attached in proximity to a first end of the platform. The work scaffold comprises a second leg assembly rotatably attached in proximity to a second end of the platform. The work scaffold comprises a latch assembly which locks the first leg assembly in an open position where the first leg assembly forms an angle between 30° and 125° with the platform so a user can be supported on the scaffold when standing on the scaffold, and unlocks the first leg assembly from the locked position so the first leg assembly can rotatably move into a closed position where the first leg assembly is folded up to the platform and is essentially in parallel with the platform. The latch assembly having a latch handle and a first latch bracket attached adjacent a first side of the platform and a second latch bracket attached adjacent a second side of the platform. The latch handle having a generally U shape formed by a center portion and a first arm and a second arm which extend from either side of the center portion. The first arm held to the platform by the first latch bracket and the second arm held to the platform by the second latch bracket. The first arm having a free end which extends through a first platform slot in the first side of the platform. The latch assembly having a first spring which biases the free end towards a top of the first platform slot in the open position. The platform having a first latch bolt extending outwards from the first side. The work scaffold comprises a first link with a link slot. The first link attached to the front leg assembly with a first latch bolt disposed in the first link slot to hold the first link to the first side of the platform. As the first leg assembly moves relative to the platform, the first link slot moves along the first latch bolt until the first latch bolt is disposed at a far end of the first link slot when the scaffold is in the open position, and the first latch bolt is disposed at a rear end of the link slot when the scaffold is in the closed position. The free end of the first arm extends out of the first platform slot and blocks the first link from moving and thus locks the first leg assembly in the open position. When the handle is moved up, the first arm moves down in the first platform slot allowing the first link slot to move along the first latch bolt and thus the first link to move to the folded position. When in the folded position, the first link holds down the free end with the first latch bolt disposed in the rear end of the slot, which holds the handle up towards the platform so the handle will not catch on an object when the scaffold is being moved.

The present invention pertains to a method for using a work scaffold. The method comprises the steps of lifting a handle disposed under the platform of the scaffold which moves a free end disposed in a platform slot to a bottom of the platform slot which allows a first link attached to a first leg assembly and to the platform to move. The free end connected to a first arm held to the platform with a latch bracket attached to the platform. The first arm connected to a center portion of the handle. There is the step of folding the first leg assembly up to the platform so the first link moves past the free end and holds the free end at the bottom of the platform slot so the handle stays close to an underside of the platform so the handle does not accidentally catch on an object while the scaffold is being transported.

The present invention pertains to a work scaffold. The scaffold comprises a platform. The scaffold comprises a first leg assembly rotatably attached in proximity to a first end of the platform. The scaffold comprises a second leg assembly rotatably attached in proximity to a second end of the platform. The scaffold comprises a first hook assembly the hook assembly comprises a first hook bracket fixedly attached to an inside of a first side of the platform, the first hook bracket having a first slot. The first hook assembly comprises a first hook disposed in the first slot. The first hook having a first end and a second hook end. The first end extending out beyond a first end of the platform when the first hook is in an extended position. The first hook assembly comprises a hook stop disposed adjacent a second end of the first hook and extending out from the first hook which prevents the second end of the first hook from moving past first slot and separating from the first hook bracket. The first hook assembly comprises a hook spring attached to the first side of the platform. The first hook having a notch that receives the hook spring which automatically moves into the notch under a bias force of the hook spring when the first hook moves into the extended position. When the first hook is in the retracted position, the hook spring presses against the first hook, holding the hook in the retracted position. The scaffold comprises a second hook having a first end extending out beyond the first end of the platform when the second hook is in an extended position, the first hook and the second hook adapted to receive a platform of a second scaffold when in the extended position.

The present invention pertains to a method for using a work scaffold. The method comprises the steps of moving a first leg assembly and a second leg assembly into an open position with respect to a platform to which they are rotatably attached. There is the step of extending a first hook outwards from under the platform. The first hook held to the platform by a hook bracket attached to a first side of the platform having a first slot that the first hook is slidably disposed. The first hook disposed in the first slot. The first hook having a first hook end and a second hook end. The first hook end extending out beyond a first hook end of the platform when the first hook is in an extended position. A hook stop is disposed adjacent a second end of the first hook and extending out from the first hook which prevents the second end of the first hook from moving past first slot and separating from the first hook bracket; and a hook spring attached to the first side of the platform. The first hook having a notch that receives the hook spring which automatically moves into the notch under a bias force of the hook spring when the first hook moves into the extended position. When the first hook is in the retracted position, the hook spring presses against the first hook, holding the hook in the retracted position. There is the step of placing a platform of a second scaffold on the first hook and a second hook which extends from the first scaffold.

The present invention pertains to a method for using a work scaffold. The method comprises the steps of moving a first leg assembly and a second leg assembly into an open position with respect to a platform to which they are rotatably attached. There is the step of extending a first hook outwards from under the platform. The first hook held to the platform by a hook bracket attached to a first side of the platform having a first slot that the first hook is slidably disposed. The first hook disposed in the first slot. The first hook having a first hook end and a second hook end. The first hook end extending out beyond a first hook end of the platform when the first hook is in an extended position. A hook stop is disposed adjacent a second end of the first hook and extending out from the first hook which prevents the second end of the first hook from moving past first slot and separating from the first hook bracket; and a hook spring attached to the first side of the platform. The first hook having a notch that receives the hook spring which automatically moves into the notch under a bias force of the hook spring when the first hook moves into the extended position. When the first hook is in the retracted position, the hook spring presses against the first hook, holding the hook in the retracted position. There is the step of placing a platform of a second scaffold on the first hook and a second hook which extends from the first scaffold.

The present invention pertains to a work scaffold. The scaffold comprises a platform. The platform comprises a first inner board having a first face and a second face in parallel and in spaced relation with the first face and a first hole and a second hole extending through the first and second inner faces of the first inner board. The platform comprises a second inner board disposed alongside the first inner board having a first face and a second face in parallel and in spaced relation with the first face of the second inner board and a first hole and a second hole extending through the first and second inner faces of the second inner board disposed alongside the first inner board. The platform comprises a first outer board having a first face and a second face in parallel and in spaced relation with the first face of the first outer board and a first hole and a second hole extending through the first face of the first outer board. The first outer board disposed adjacent the first inner board with the first inner board disposed between the first outer board and the second inner board. The platform comprises a second outer board having a first face and a second face in parallel and in spaced relation with the first face of the second outer board and a first hole and a second hole extending through the first face of the second outer board. The second outer board disposed adjacent the second inner board with the second inner board disposed between the second outer board and the first inner board. The platform comprises a first cross member extending through the first holes of the first and second inner boards and the first and second outer boards but not extending through the outer faces of the first and second outer boards. The platform comprises a second cross member extending through the second holes of the first and second inner boards and the first and second. The platform comprises outer boards.

The present invention pertains to a method for forming a work scaffold. The method comprises the steps of inserting a first cross member through a first hole that extends through a first face and a second face of a first inner board and through a first hole in a first face of a first outer board but not through a second face of the first outer board. There is the step of inserting a second cross member through a second hole that extends through the first face and the second face of the first inner board and through a second hole in the first face of the first outer board but not through the second face of the first outer board. There is the step of inserting the first cross member through a first hole that extends through a first face and a second face of a second inner board and through a first hole in a first face of a second outer board but not through a second face of a second outer board. There is the step of inserting the second cross member through a second hole that extends through the first face and the second face of the second inner board and through a second hole in the first face of the second outer board but not through the second face of the second outer board. There is the step of placing a first end cap on a first end of the first and second inner boards and the first and second outer boards. There is the step of placing a second end cap on a second end of the first and second inner boards and the first and second outer boards. There is the step of attaching a first leg assembly in proximity to the first and cap. There is the step of attaching a second leg assembly in proximity to the second and cap.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
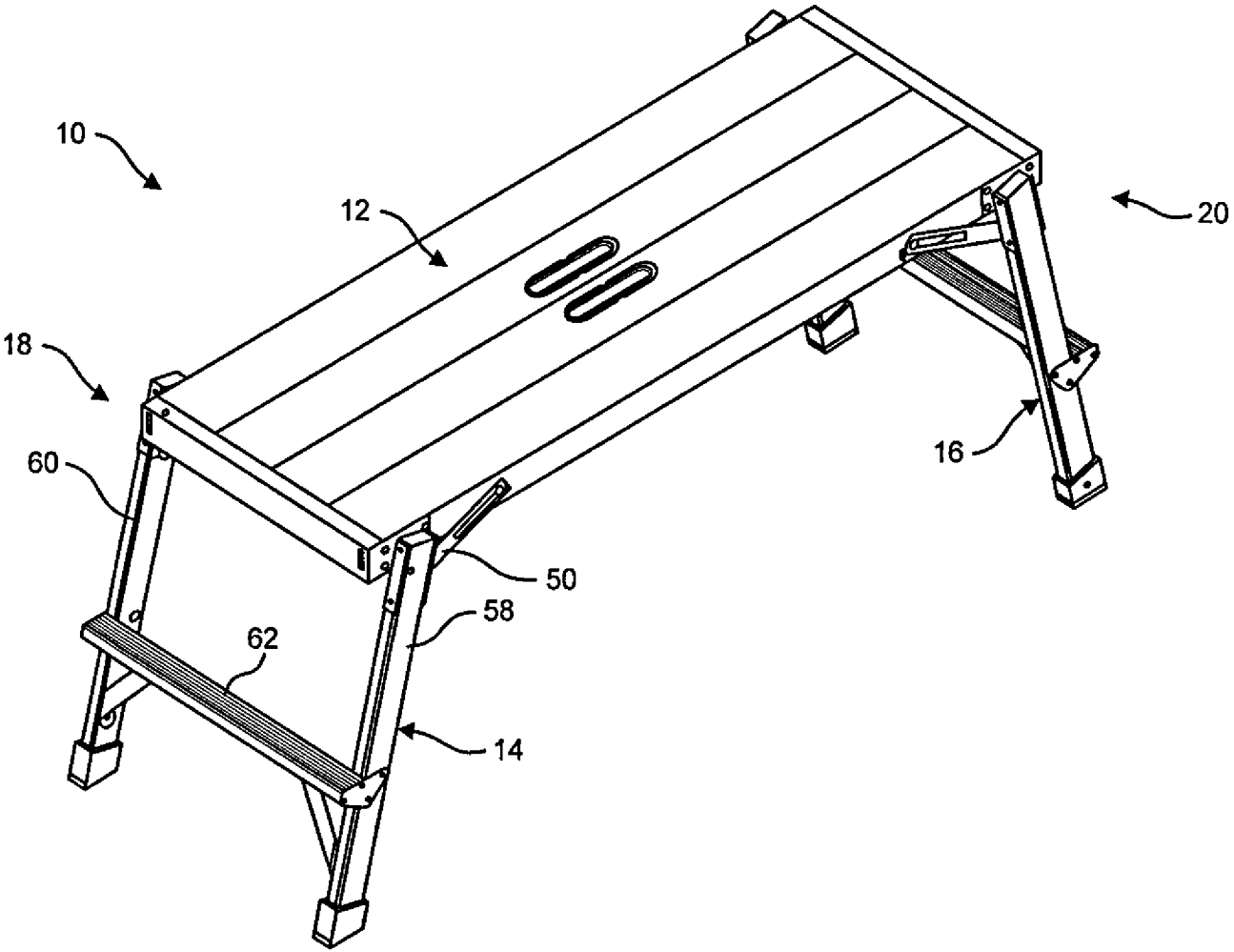
FIG. 1 is a perspective view of a work scaffold of the present invention.
Figure 2A:
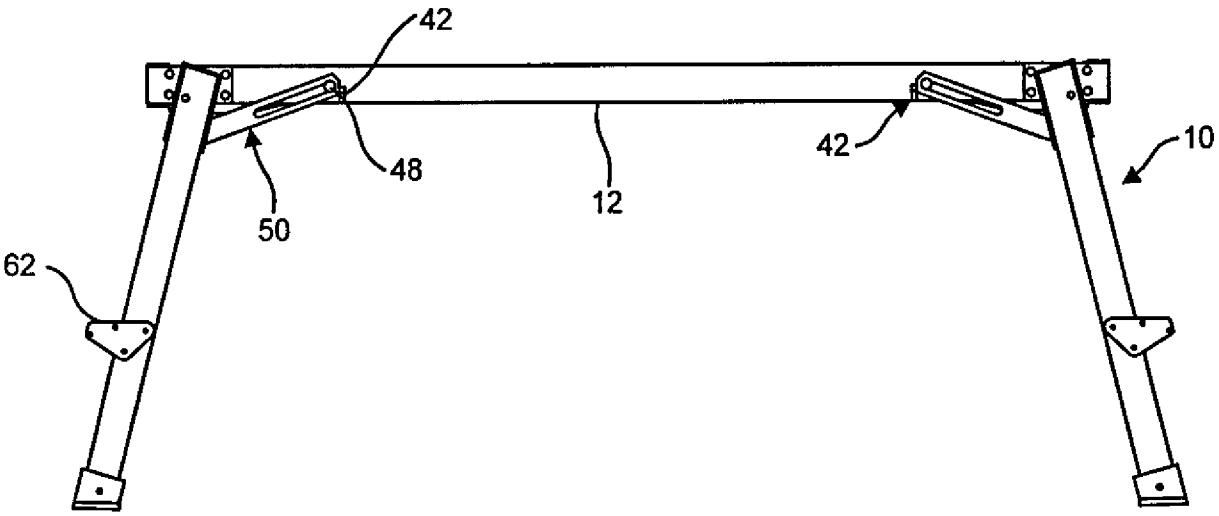
FIG. 2A is a side view of the work scaffold.
Figure 2B:
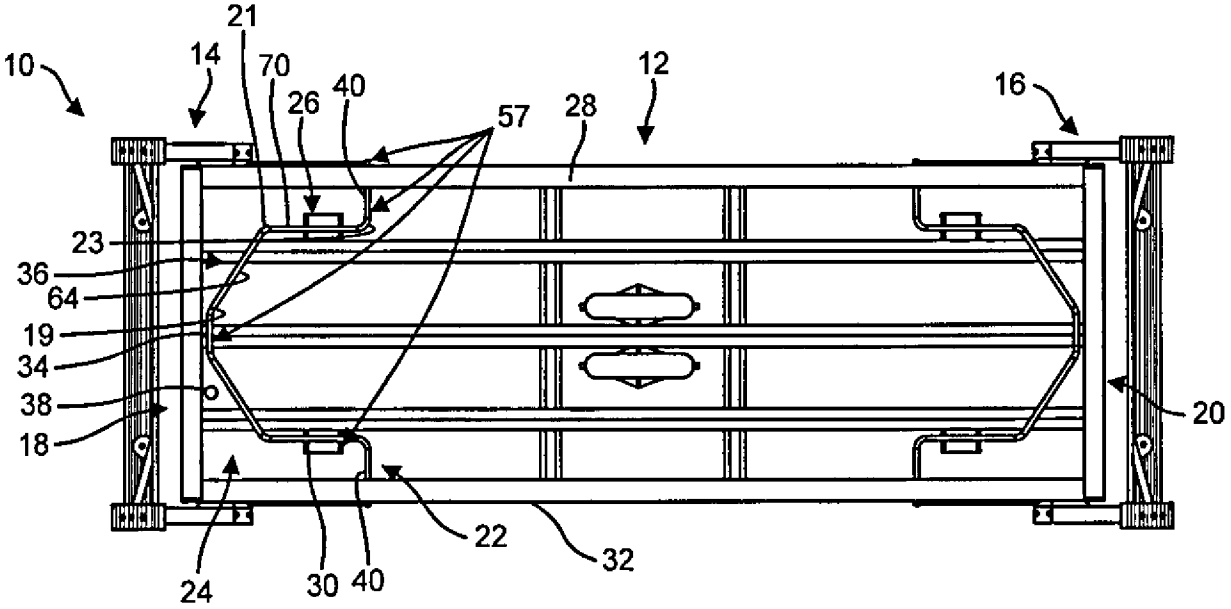
FIG. 2B is an underside view of the work scaffold.
Figure 3:
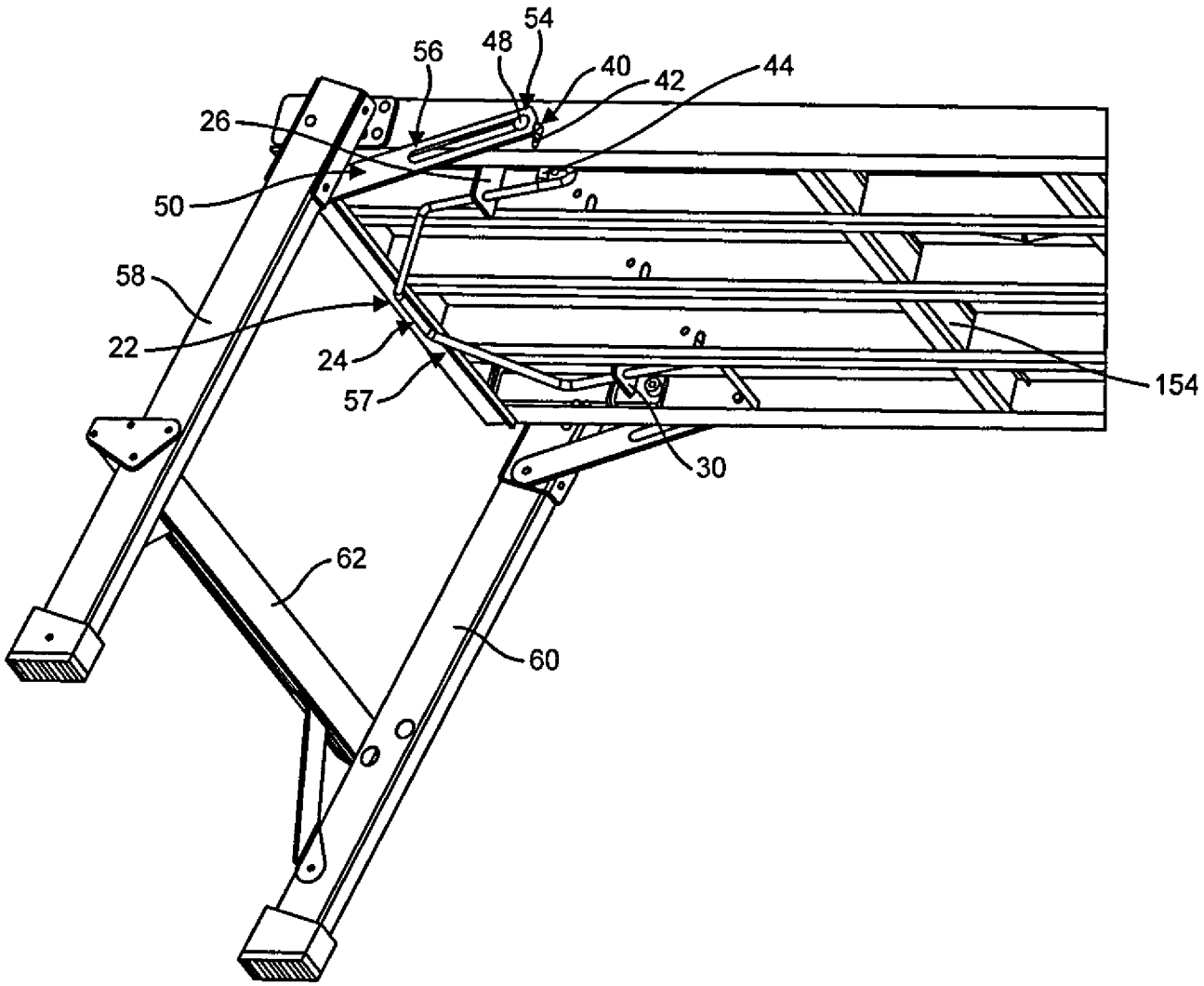
FIG. 3 is an underside perspective view of a portion of the work scaffold with the Free and of the latch at the top of the first platform slot.
Figure 4:
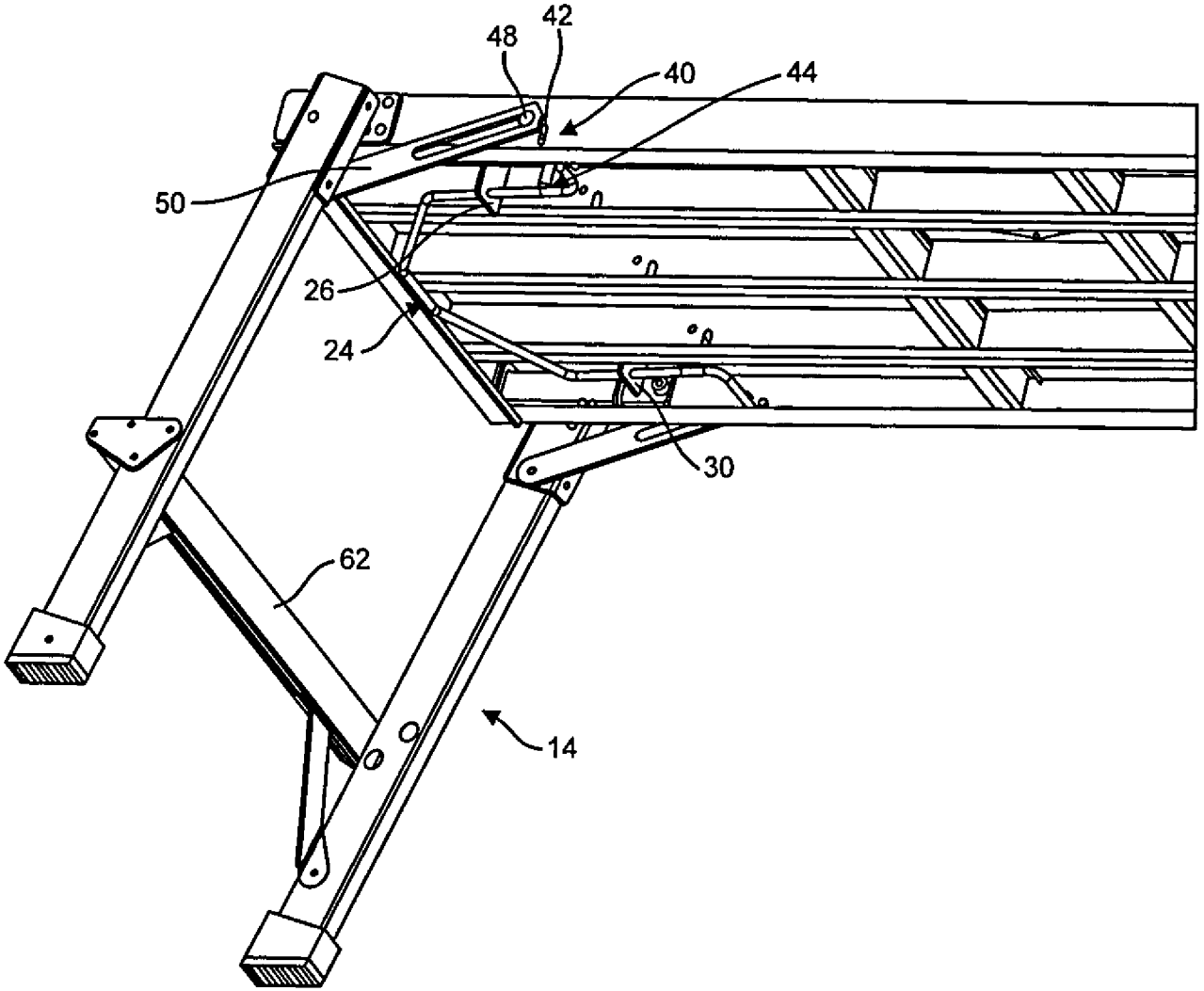
FIG. 4 is an underside perspective view of a portion of the work platform with the free end of the latch at the bottom of the first platform slot.
Figure 5:
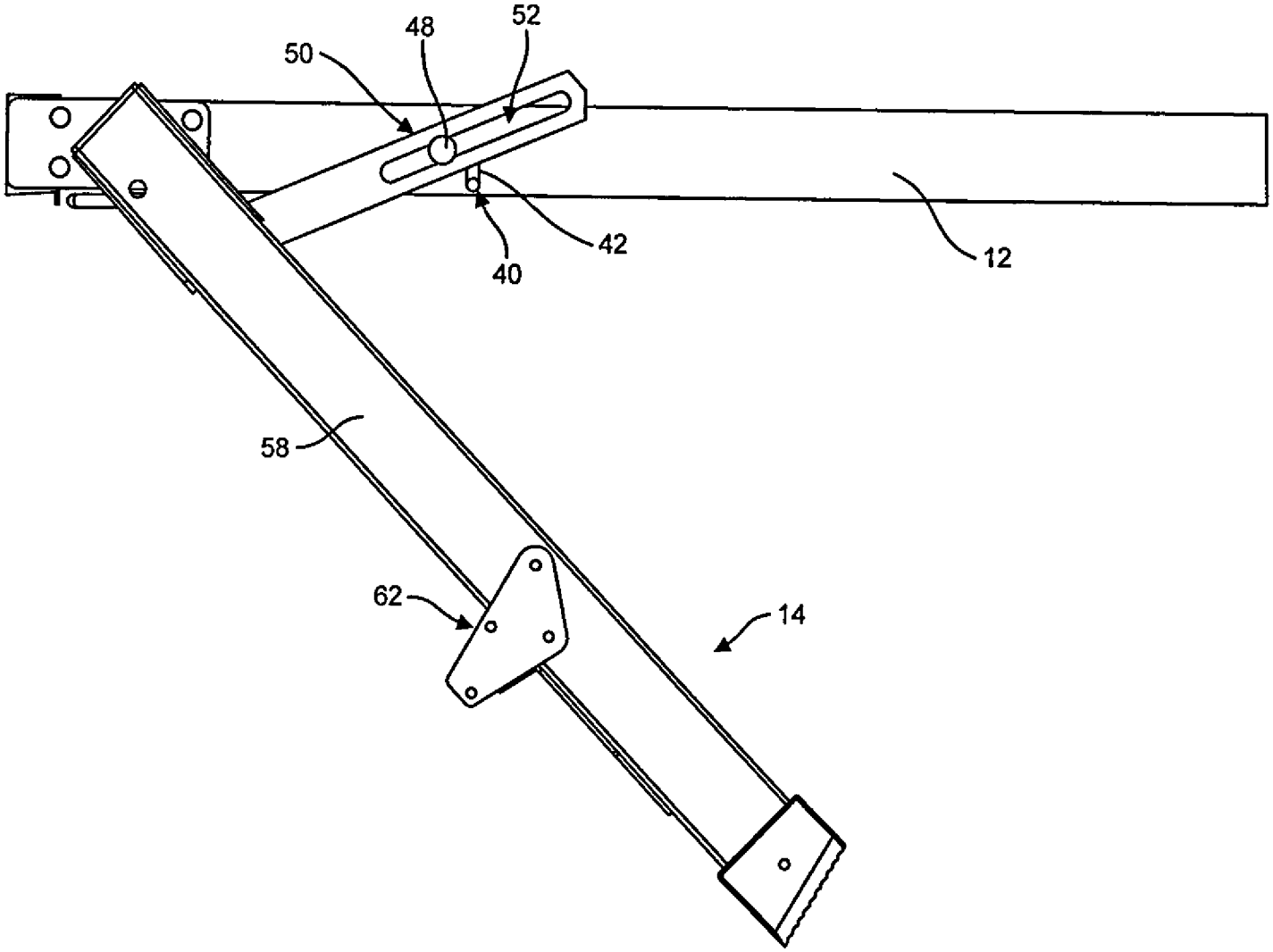
FIG. 5 is a side view of a portion of the work platform with the first leg assembly in a partially open position.
Figure 6A:
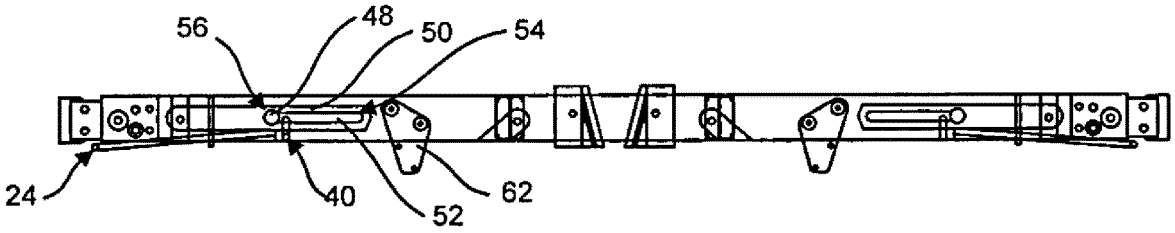
FIG. 6A is a side view of the work platform in a closed position.
Figure 6B:
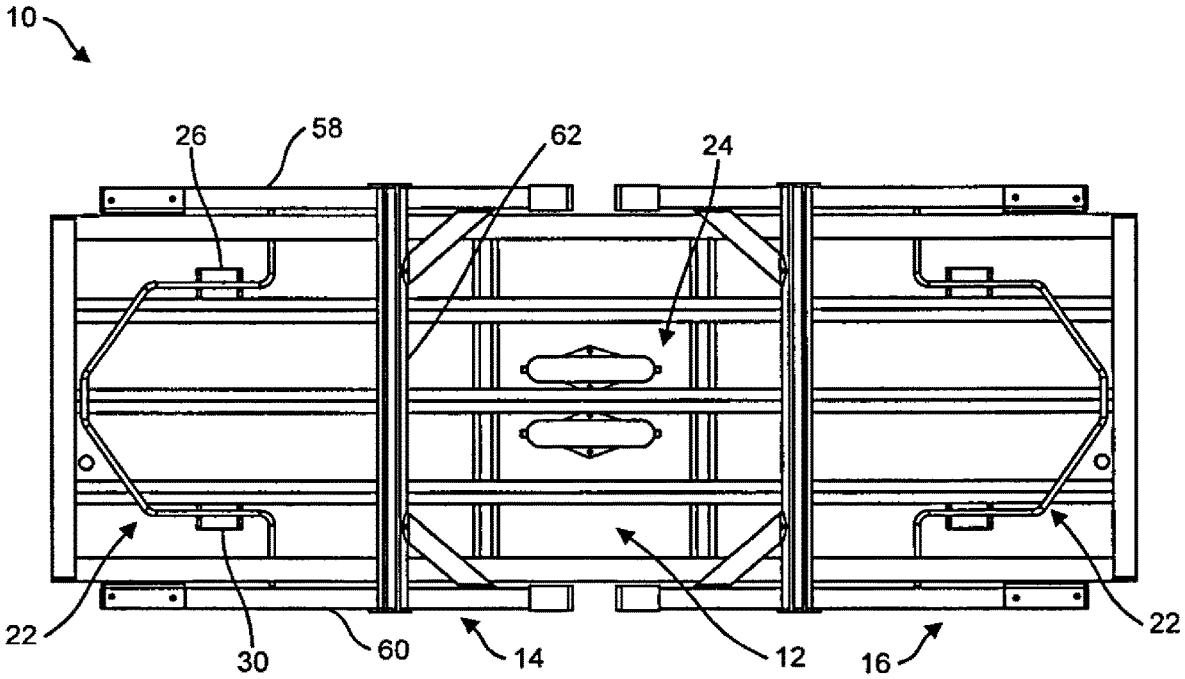
FIG. 6B is an underside view of the work scaffold in the closed position.

Referring now to the drawings wherein like reference numerals refer to similar or identical parts throughout the several views, and more specifically to FIGS. 1-6B thereof, there is shown a work scaffold 10. The work scaffold 10 comprises a platform 12, as shown in FIG. 1. The work scaffold 10 comprises a first leg assembly 14 rotatably attached in proximity to a first end 18 of the platform 12. The work scaffold 10 comprises a second leg assembly 16 rotatably attached in proximity to a second end 20 of the platform 12. The work scaffold 10 comprises a latch assembly 22, as shown in FIGS. 2A, 2B, 3, 4 and 5, which locks the first leg assembly 14 in an open position where the first leg assembly 14 forms an angle between 30° and 125° with the platform 12 so a user can be supported on the scaffold 10 when standing on the scaffold 10, and unlocks the first leg assembly 14 from the locked position so the first leg assembly 14 can rotatably move into a closed position where the first leg assembly 14 is folded up to the platform 12 and is essentially in parallel with the platform 12, as shown in FIGS. 6A and 6B. The latch assembly 22 has a latch handle 24 and a first latch bracket 26 attached adjacent a first side 28 of the platform 12 and a second latch bracket 30 attached adjacent a second side 32 of the platform 12. The latch handle 24 having a generally U shape formed by a center portion 34 and a first arm 36 and a second arm 38 which extend from either side of the center portion 34. The first arm 36 held to the platform 12 by the first latch bracket 26 and the second arm 38 held to the platform 12 by the second latch bracket 30. The first arm 36 having a free end 40 which extends through a first platform 12 slot in the first side 28 of the platform 12. The latch assembly 22 having a first spring 44, as shown in FIG. 3, which biases the free end 40 towards a top 46 of the first platform slot 42 in the open position. The platform 12 having a first latch bolt 48 extending outwards from the first side 28. The work scaffold 10 comprises a first link 50 with a link slot 52. The first link 50 attached to the front leg assembly with the first latch bolt 48 disposed in the first link slot 52 to hold the first link 50 to the first side 28 of the platform 12. As the first leg assembly 14 moves relative to the platform 12, the first link slot 52 moves along the first latch bolt 48 until the first latch bolt 48 is disposed at a far end 54 of the first link slot 52 when the scaffold 10 is in the open position; and the first latch bolt 48 is disposed at a rear end 56 of the link slot 52 when the scaffold 10 is in the closed position, as shown in FIG. 6A. The free end 40 of the first arm 36 extends out of the first platform slot 42 and blocks the first link 50 from moving and thus locks the first leg assembly 14 in the open position, as shown in FIG. 3. When the handle 24 is moved up, the first arm 36 moves down in the first platform slot 42, as shown in FIG. 4, allowing the first link slot 52 to move along the first latch bolt 48 and thus the first link 50 to move to the folded position, as shown in FIGS. 6A and 6B. When in the folded position, the first link 50 holds down the free end 40 with the first latch bolt 48 disposed in the rear end 56 of the slot, which holds the handle 24 up towards the platform 12 so the handle 24 will not catch on an object when the scaffold 10 is being moved.

The first leg assembly 14 may have a first rail 58 and a second rail 60 in spaced relation and in parallel with the first rail 58, and a support bar 62 attached to the first rail 58 and second rail 60 and disposed in front of the first and second rails 58, 60, as shown in FIG. 1. The first arm 36 may have a first segment 64 that extends at a first end of the first segment 64 from a first end 19 of the center portion 34 at an angle between 20° and 55°, a second segment 70 that extends at a first end of the second segment 70 from a second end 21 of the first segment 64 at an angle between 20° and 50°, as shown in FIG. 2B. The free end 40 may extend at an angle of about 90° from a second end 23 of the second segment 70. The first and second rails 58, 60 of the first leg assembly 14 may be coplanar with the platform 12 in the closed position, as shown in FIG. 6B. When the scaffold 10 is being placed into the open position, as the first leg assembly 14 is unfolded and moved into the open position, the first link 50 is pulled with the first leg assembly 14 so the link slot 52 moves along the latch bolt until the latch bolt is at the foremost end of the link slot 52, whereupon the first free end 40, under the bias force of the latch spring, moves the free end 40 to the top 46 of the platform slot. By the free end 40 being at the top 46 of the platform slot, it blocks the first link 50 from moving, and thus locks the scaffold 10 in the open position. The other side of the platform 12, and both sides of the other end of the platform 12 have the same type of latch assembly 22 and handle-free end engagement as described for the first side 28 in the first link 50 of the scaffold 10. The scaffold 10 may include hook assemblies, as described below. The scaffold 10 may be formed using the boards with holes and cross members inserted into them, as described below.

The present invention pertains to a method for using a work scaffold 10. The method comprises the steps of lifting a handle 24 disposed under the platform 12 of the scaffold 10 which moves a free end 40 disposed in a platform slot to a bottom of the platform slot which allows a first link 50 attached to a first leg assembly 14 and to the platform 12 to move. The free end 40 connected to a first arm 36 held to the platform 12 with a latch bracket attached to the platform 12. The first arm 36 connected to a center portion 34 of the handle 24. There is the step of folding the first leg assembly 14 up to the platform 12 so the first link 50 moves past the free end 40 and holds the free end 40 at the bottom of the platform slot so the handle 24 stays close to an underside of the platform 12 so the handle 24 does not accidentally catch on an object while the scaffold 10 is being transported.

The present invention pertains to a work scaffold 10, as shown in FIG. 1. The scaffold 10 comprises a platform 12. The scaffold 10 comprises a first leg assembly 14 rotatably attached in proximity to a first end 18 of the platform 12. The scaffold 10 comprises a second leg assembly 16 rotatably attached in proximity to a second end 20 of the platform 12. The scaffold 10 comprises a first hook assembly 84, as shown in FIGS. 7-11. The hook assembly comprises a first hook bracket 86 fixedly attached to an inside of a first side 28 of the platform 12. The first hook bracket 86 having a first hook slot 88, as shown in FIG. 11. The first hook assembly 84 comprises a first hook 90 disposed in the first hook slot 88. The first hook 90 having a first hook end 92 and a second hook end 94. The first hook end 92 extending out beyond a first end 18 of the platform 12 when the first hook 90 is in an extended position. The first hook assembly 84 comprises a hook stop 96 disposed adjacent the second hook end 94 of the first hook 90 and extending out from the first hook 90 which prevents the second hook end 94 of the first hook 90 from moving past the first hook slot 88 and separating from the first hook bracket 86. The first hook assembly 84 comprises a hook spring 98 attached to the first side 28 of the platform 12. The first hook 90 having a notch 100 that receives the hook spring 98 which automatically moves into the notch 100 under a bias force of the hook spring 98 when the first hook 90 moves into the extended position. When the first hook 90 is in the retracted position, the hook spring 98 presses against the first hook 90, holding the hook in the retracted position. The scaffold 10 comprises a second hook 102 having a first hook end 92, like that shown in FIG. 11, extending out beyond the first end 18 of the platform 12 when the second hook 102 is in an extended position. The first hook 90 and the second hook 102 adapted to receive a platform 12 of a second scaffold 10 when in the extended position.

The first hook bracket 86 may have a web 104 with a first flange 106 having the first hook slot 88 extending in proximity to a first end 188 of the web 104 and a second flange 108 having a second hook slot 89 extending in proximity to a second end 200 of the web 104. The first hook 90 disposed in the first and second hook slots. The web 104 attached by fasteners to the first side 28. The first hook end 92 of the first hook 90 may have a tip 110 which flares outward. The web 104, first flange 106 and second flange 108 and first and second hook slots may each be rectangular shaped. The hook may be rectangular shaped which fits in the rectangular shaped first and second hook slots. The tip 110 may be triangular shaped and prevents the first hook 90 from moving through the first hook slot 88 when the first hook 90 is moved inward into the platform 12. The notch 100 may be disposed in a bottom surface 112 of the web 104. The other side of the platform 12 has a second hook assembly identical to the first hook assembly 84 in components in operation. More than two scaffolds can be linked together in the open position where each scaffold 10 has at a first end 18 first and second hook assemblies, as described above. Each additional scaffold 10 can have its platform 12 placed on hooks extending from the platform 12 of the scaffold 10 to which it is to be connected, as described below.

The present invention pertains to a method for using a work scaffold 10. The method comprises the steps of moving a first leg assembly 14 and a second leg assembly 16 into an open position with respect to a platform 12 to which they are rotatably attached. There is the step of extending a first hook 90 outwards from under the platform 12. The first hook 90 held to the platform 12 by a hook bracket attached to a first side 28 of the platform 12 having a first slot that the first hook 90 is slidably disposed. The first hook 90 disposed in the first slot. The first hook 90 having a first hook end 92 and a second hook end 94. The first hook end 92 extending out beyond a first hook end 92 of the platform 12 when the first hook 90 is in an extended position. A hook stop 96 is disposed adjacent a second end 20 of the first hook 90 and extending out from the first hook 90 which prevents the second end 20 of the first hook 90 from moving past first slot and separating from the first hook bracket 86; and a hook spring 98 attached to the first side 28 of the platform 12. The first hook 90 having a notch 100 that receives the hook spring 98 which automatically moves into the notch 100 under a bias force of the hook spring 98 when the first hook 90 moves into the extended position. When the first hook 90 is in the retracted position, the hook spring 98 presses against the first hook 90, holding the hook in the retracted position. There is the step of placing a platform 12 of a second scaffold 10 on the first hook 90 and a second hook 102 which extends from the first scaffold 10.

The present invention pertains to a work scaffold 10, as shown in FIGS. 12A, 12B, 13A and 13B. The scaffold 10 comprises a platform 12. The platform 12 comprises a first inner board 140 having a first face 142 and a second face 144 in parallel and in spaced relation with the first face 142 and a first hole 146 and a second hole 160 extending through the first and second inner faces of the first inner board 140. The platform 12 comprises a second inner board 148 disposed alongside the first inner board 140 having a first face 142 and a second face 144 in parallel and in spaced relation with the first face 142 of the second inner board 148 and a first hole 146 and a second hole 160 extending through the first and second inner faces of the second inner board 148 disposed alongside the first inner board 140. The platform 12 comprises a first outer board 150 having a first face 142 and a second face 144 in parallel and in spaced relation with the first face 142 of the first outer board 150 and a first hole 146 and a second hole 160 extending through the first face 142 of the first outer board 150. The first outer board 150 disposed adjacent the first inner board 140 with the first inner board 140 disposed between the first outer board 150 and the second inner board 148. The platform 12 comprises a second outer board 152 having a first face 142 and a second face 144 in parallel and in spaced relation with the first face 142 of the second outer board 152 and a first hole 146 and a second hole 160 extending through the first face 142 of the second outer board 152. The second outer board 152 disposed adjacent the second inner board 148 with the second inner board 148 disposed between the second outer board 152 and the first inner board 140. The platform 12 comprises a first cross member 154 extending through the first holes 146 of the first and second inner boards 140, 148 and the first and second outer boards 150, 152 but not extending through the outer faces of the first and second outer boards 150, 152. The platform 12 comprises a second cross member 156 extending through the second holes 160 of the first and second inner boards 140, 148 and the first and second outer boards 150, 152 but not extending through the outer faces of the first and second outer boards 150, 152.

Each board may be hollow and has a c-shaped cross-section. The first and second inner boards 140, 148 each may have a handle slot 158 extending in parallel with their longitudinal axis which forms a handle 24 when positioned alongside each other that can be used to lift the scaffold 10 by a user grabbing the handle 24 with a hand of the user. The handle slot 158 is disposed in the board web 162 of each inner board. The first and second faces extend down from each side of a board web 162 of each board to form the c-shaped cross-section. At a free end 166 of each face may be a tab that extends inwards.

The platform 12 may include an end cap 170 fitting over each end of the inner and outer boards and closing them off. Each end cap 170 has a c-shaped cross-section defined by an end web 172 with a top flange 174 and a bottom flange 176 extending in parallel and spaced relation from each other and from the ends of the end web 172. The top flange 174 is disposed on the board web 162 of each board and the bottom flange 176 disposed on the tabs 164 of each board. Each end web 172 may have a first hook slot 88 through which the first hook 90 may extend. The first hook bracket 86 may be fixedly attached to the inside of the second face 144 of the first outer board 150. The cross members may have an I-shaped cross-section.

The present invention pertains to a method for forming a work scaffold 10. The method comprises the steps of inserting a first cross member 154 through a first hole 146 that extends through a first face 142 and a second face 144 of a first inner board 140 and through a first hole 146 in a first face 142 of a first outer board 150 but not through a second face 144 of the first outer board 150. There is the step of inserting a second cross member 156 through a second hole 160 that extends through the first face 142 and the second face 144 of the first inner board 140 and through a second hole 160 in the first face 142 of the first outer board 150 but not through the second face 144 of the first outer board 150. There is the step of inserting the first cross member 154 through a first hole 146 that extends through a first face 142 and a second face 144 of a second inner board 148 and through a first hole 146 in a first face 142 of a second outer board 152 but not through a second face 144 of a second outer board 152. There is the step of inserting the second cross member 156 through a second hole 160 that extends through the first face 142 and the second face 144 of the second inner board 148 and through a second hole 160 in the first face 142 of the second outer board 152 but not through the second face 144 of the second outer board 152. There is the step of placing a first end cap 170 on a first end 18 of the first and second inner boards 140, 148 and the first and second outer boards 150, 152. There is the step of placing a second end cap 170 on a second end 20 of the first and second inner boards 140, 148 and the first and second outer boards 150, 152. There is the step of attaching a first leg assembly 14 in proximity to the first and cap. There is the step of attaching a second leg assembly 16 in proximity to the second and cap.

FIG. 1 shows an overall view of the work scaffold 10, leg assemblies are opened and locked into place. The leg assemblies are similar to existing Werner work platform leg assemblies with one difference being that the legs are made from box channel rather than C channel. Box channel is used to reduce weight while increasing stiffness. The deck assembly is made of several aluminum extrusions, the details of which are described below.

FIGS. 2*a* and 2*b* show right side and underside views of the work scaffold 10. Links serve to position the leg assemblies in the open position. Slots in the links engage the latch bolts. The slots enable the links to slide relative to the latch bolts which permit the leg assemblies to move to the closed position. Latches 57 are mounted on the underside of the deck assembly by means of latch brackets. These latches 57, in this embodiment, are made from bent steel rods. The free ends 40 of the latches 57 protrude through platform slots in the sides of the platform 12. It can be seen that when the free ends 40 of the latches 57 are at the upper ends of the platform slots, the latch 57 blocks movement of the links. When the free ends 40 of the latches 57 are at the lower ends of the platform slots, the links are free to move.

Figure 14A:
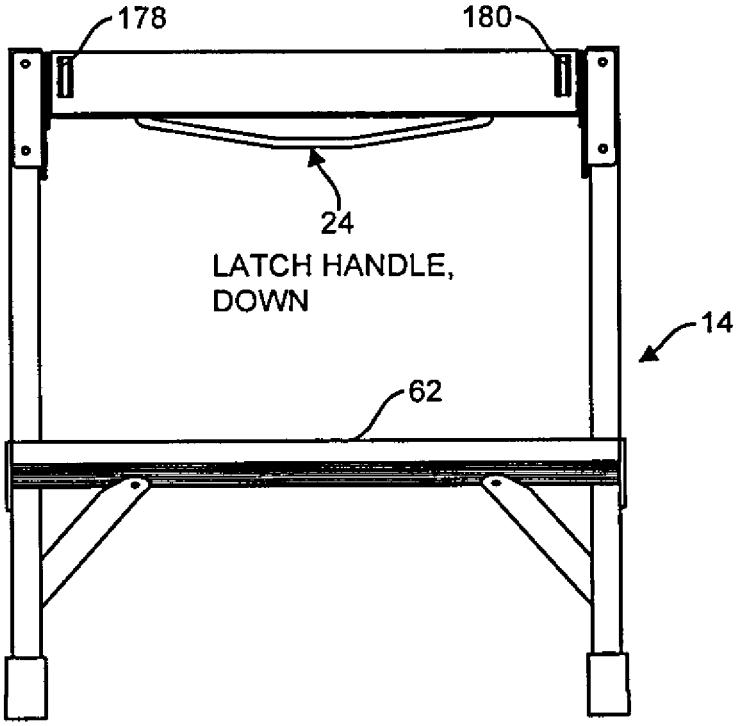
FIG. 14A is a front view of the work scaffold with the latch handle down.
Figure 14B:
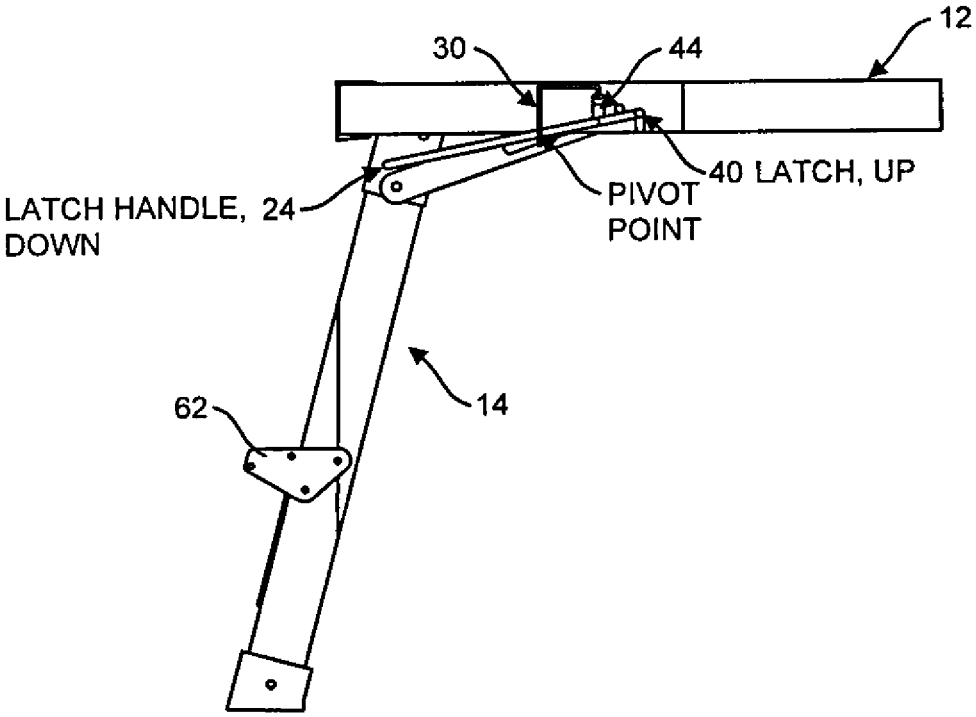
FIG. 14B is a side view of a portion of the work scaffold with the latch handle down.

FIG. 3 shows a perspective underside view. FIG. 14A shows a front view and FIG. 14B shows a side view of one end of the work scaffold 10. As shown, the latch 57 is in the engaged position and is blocking the motion of the links. Tension latch springs work in conjunction with the latch brackets to bias the latch 57 into this position. It can be understood that when the free ends 40 of the latch 57 are in this up position, the latch handle 24 portion of the latch 57 is in its down position due to its pivoting about the latch brackets.

Figure 15A:
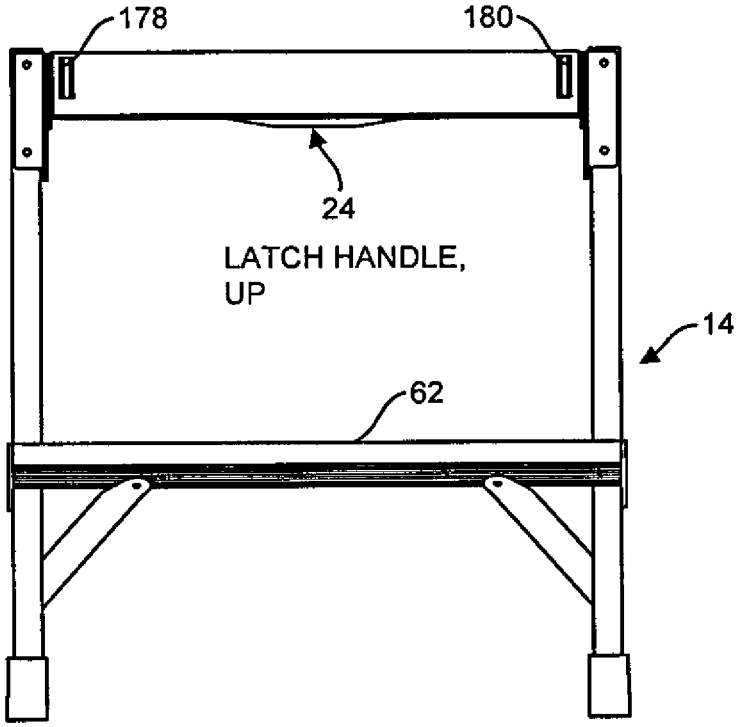
FIG. 15A is a front view of the work scaffold with the latch handle up.
Figure 15B:
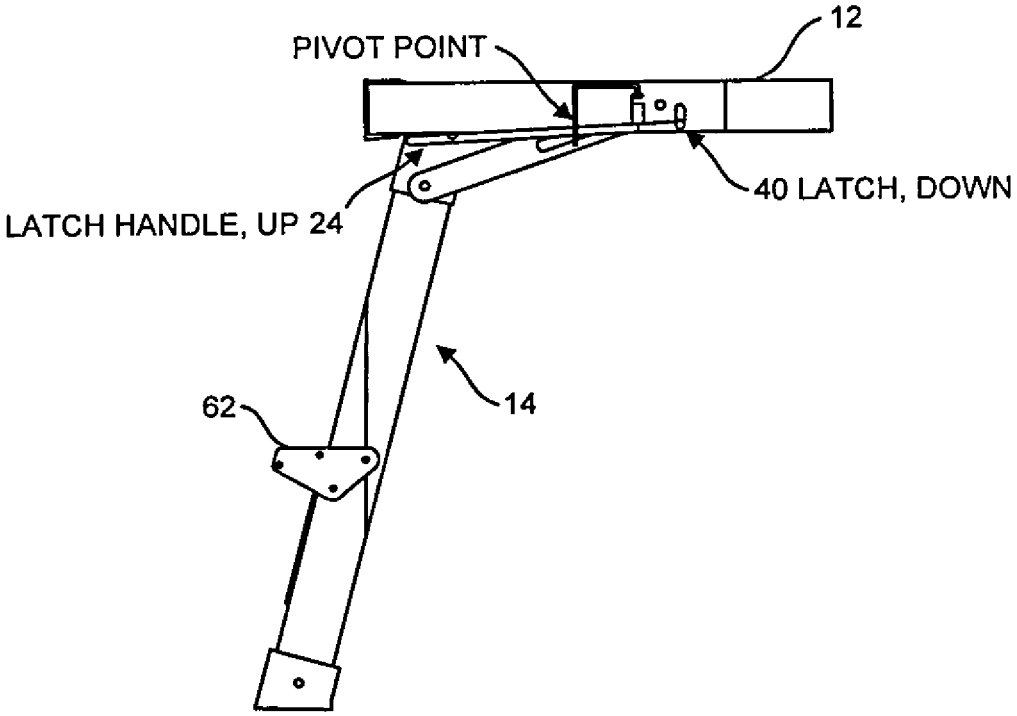
FIG. 15B is a side view of a portion of the scaffold with the latch handle up.

FIG. 4 is the same as FIG. 3. FIG. 15A is the same as FIG. 14A, and FIG. 15B is the same as FIG. 14B except the latch handle 24 portion of the latch 57 has been lifted, causing the latch 57 to pivot about the latch brackets, the latch springs to stretch, and the ends 40 of the latch 57 to move downward, thus unblocking the links. At this point, the leg assemblies can be folded. Thus, to fold the leg assemblies, the user lifts the latch handle 24 and manually moves the leg assembly to the folded position.

FIG. 5 shows the leg assembly partially folded.

FIGS. 6*a* and 6*b* show right side and underside views of the work scaffold 10 with both leg assemblies folded. Notice in the phantom right side view that the links hold the ends 40 of the latch 57 in the down position, thus keeping the latch handle 24 up close to the underside of the platform 12. This prevents the latch handles 24 from catching on things when the leg assemblies are in the folded position. To open the leg assemblies, the user merely moves the leg assemblies manually to the open position. Once they are open, the latch springs will automatically move the ends 40 of the latch 57 to block the links, thus locking the leg assemblies in the open position.

Figure 7:
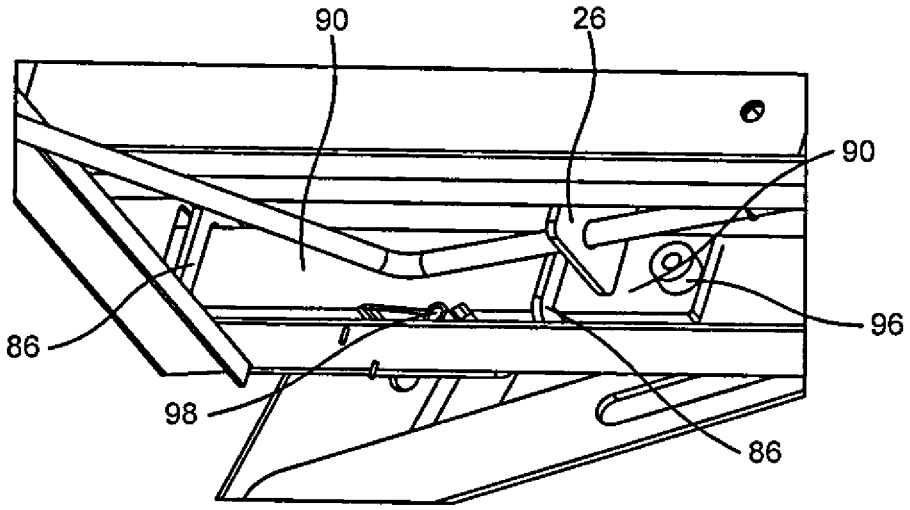
FIG. 7 is an underside perspective view of the work scaffold showing the first hook assembly with the first talk in a retracted position.
Figure 8:
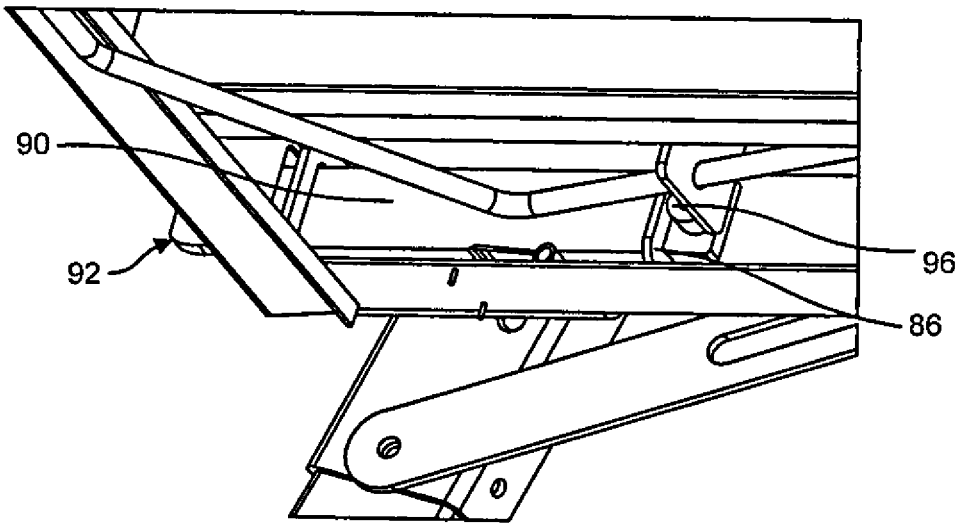
FIG. 8 is an underside perspective view of the work scaffold showing the first hook assembly with the first hook in an extended position.

FIGS. 7, 8, and 11 show the components and operation of the hook feature. Hooks enable two work platforms to be quickly joined together end to end. The hook is a close sliding fit in the hook bracket which is fastened to the platform 12. A hook spring 98 bears up on the underside of the hook which tends to gently hold the hook in the retracted position seen in FIG. 7. To extend the hooks, the user simply slides the hooks manually. FIG. 8 and FIG. 11 show the hook extended. Hook stops 96 prevent the hooks from extending too far and coming out of the hook brackets. When the hook is fully extended, the hook spring 98 engages a notch 100 in the hook. This engagement more positively holds the hooks in the extended position. The notch 100 is shaped so that the hooks may be retracted by smacking them back in with the heel of the hand. It can be seen that the shape of the tip 110 at the end of the hook prevents them from being retracted too far. The area of the first hook 90 between the tip 110 and the first flange 106 of the first hook bracket 86 provides a receiving zone 114 upon which the first flange 106 of the other work platform is disposed when the first and second scaffolds are engaged together, as more fully explained below.

Figure 9A:
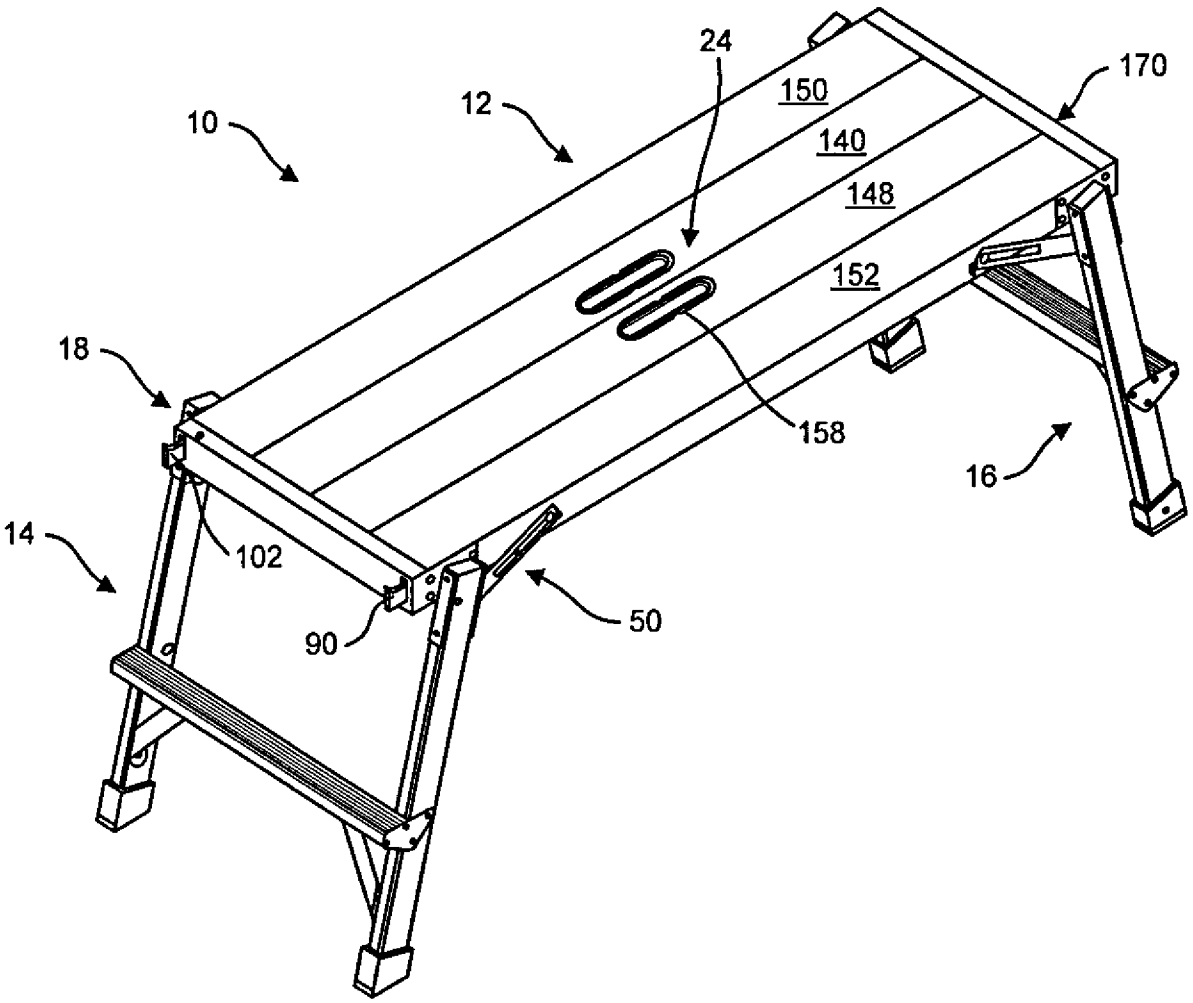
FIG. 9A is a perspective view of the work scaffold with the first and second hooks in an extended position.
Figure 9B:
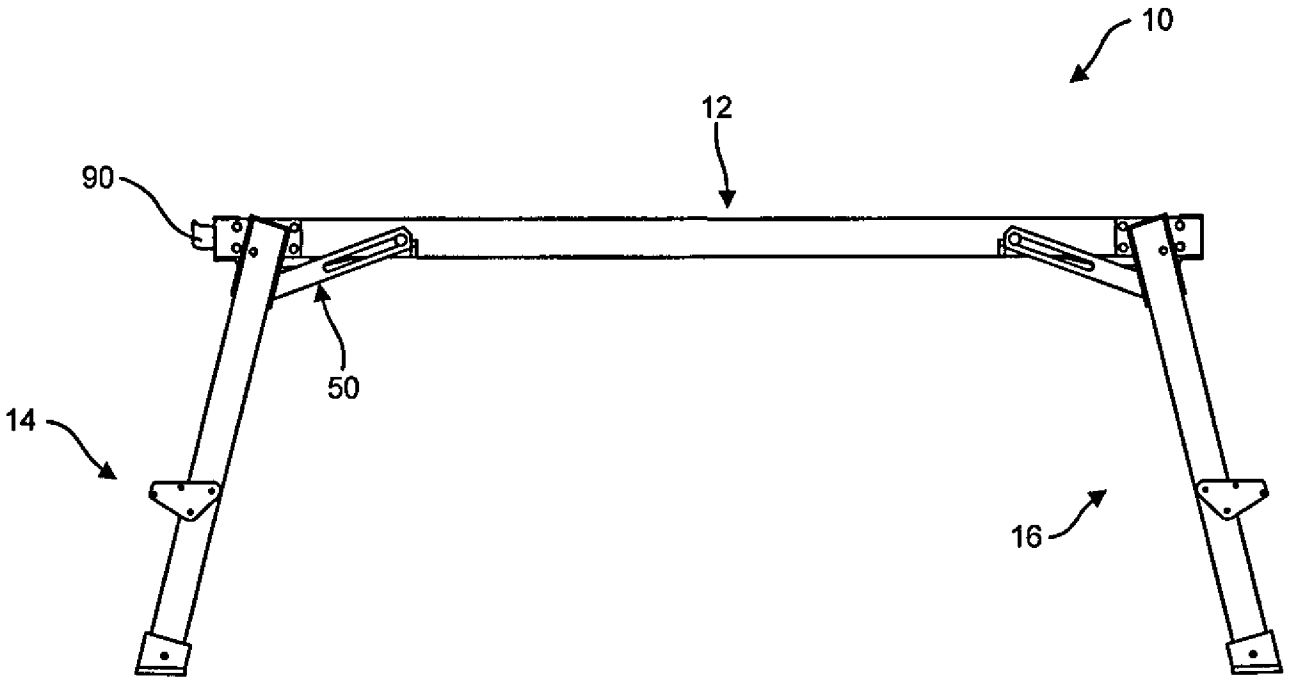
FIG. 9B is a side view of the work scaffold with the first and second hooks in an extended position.

FIGS. 9*a* and 9*b* show the entire work scaffold 10 with the hooks extended. Note that hooks are mounted on the left and right sides of the work platform 12 at one end only. At the other end, hook brackets alone are mounted. These hook brackets are intended to receive the hooks from the mating work platform 12 when the work platforms are ganged together.

Figure 10A:
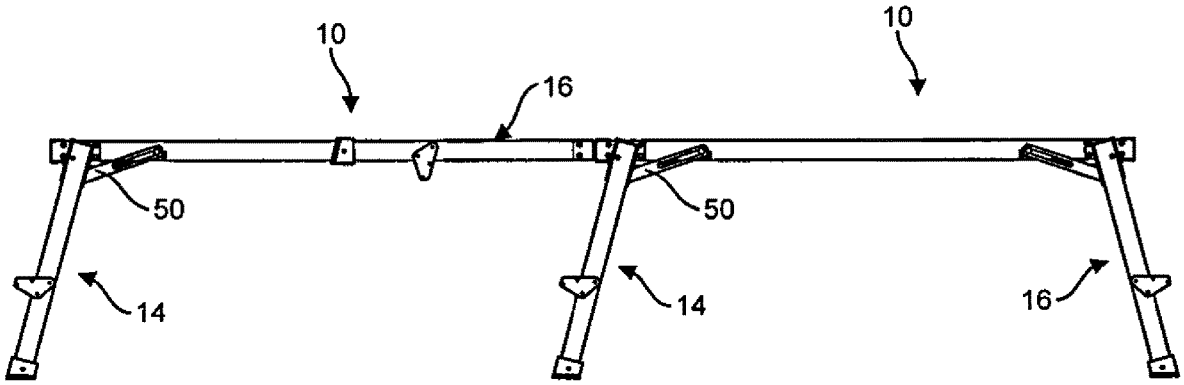
FIG. 10A is a side view of to work scaffold connected together.
Figure 10B:
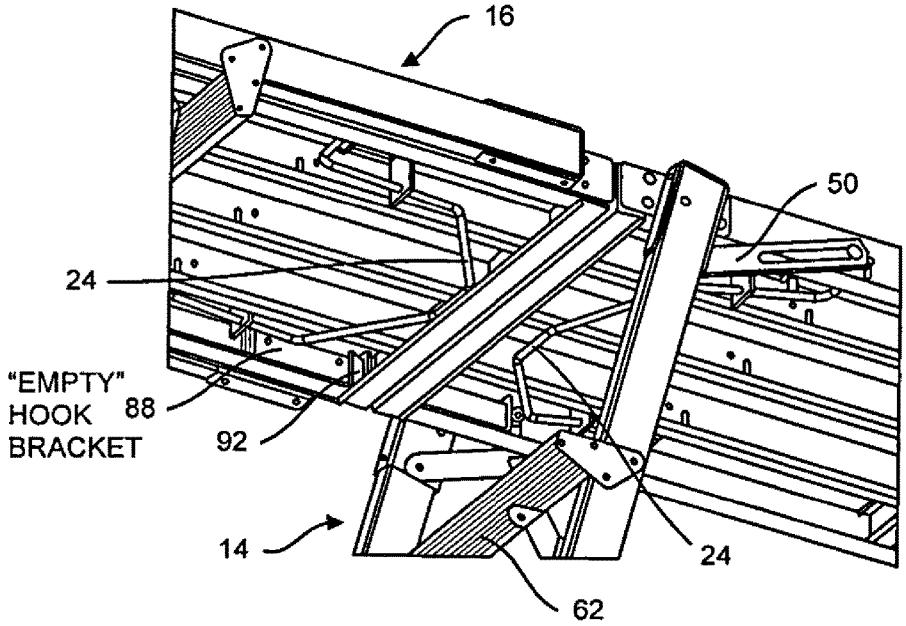
FIG. 10B is an underside perspective you of a portion of the two scaffolds connected together.
Figure 11:
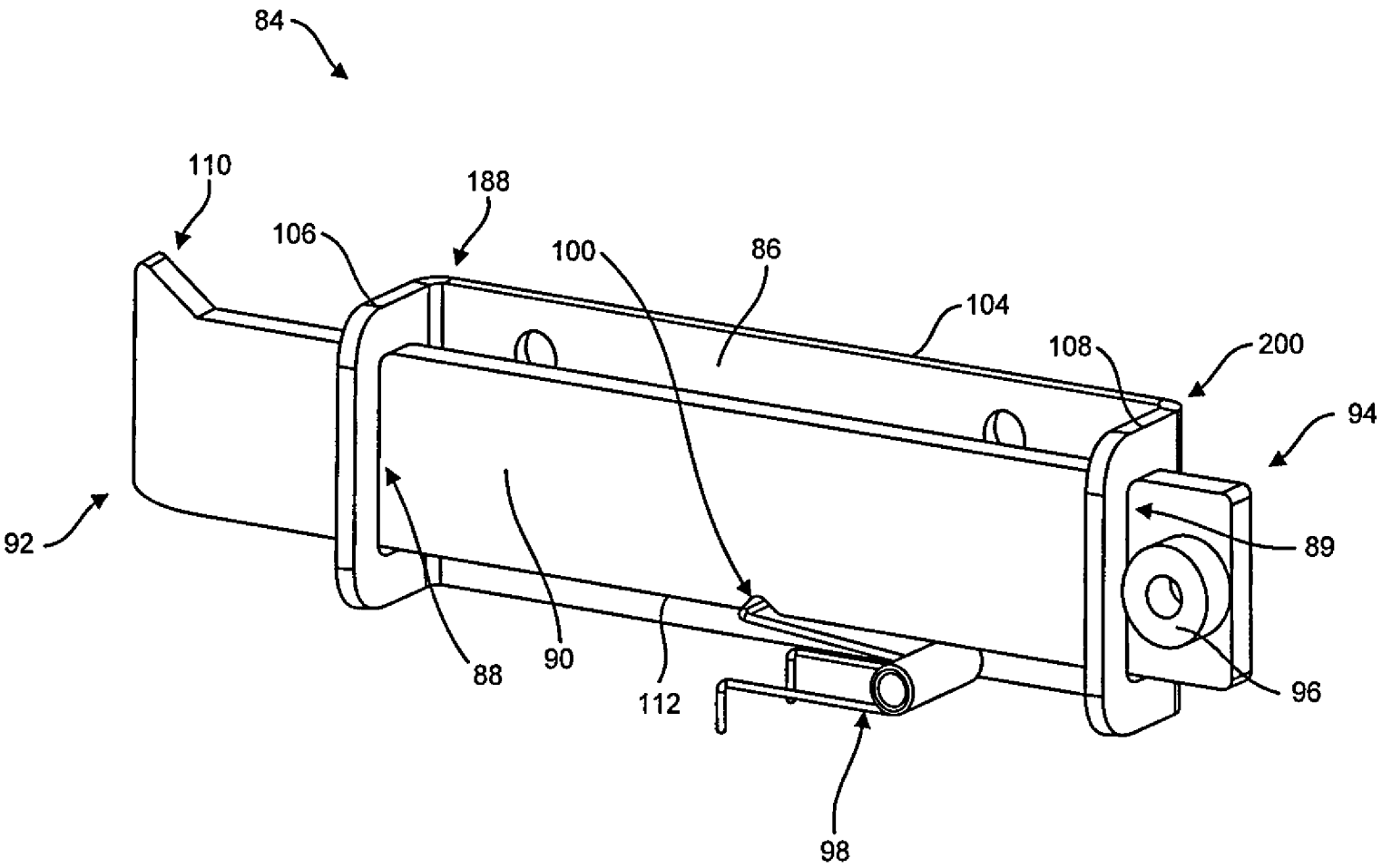
FIG. 11 is a perspective view of the first hook assembly.
Figure 12A:
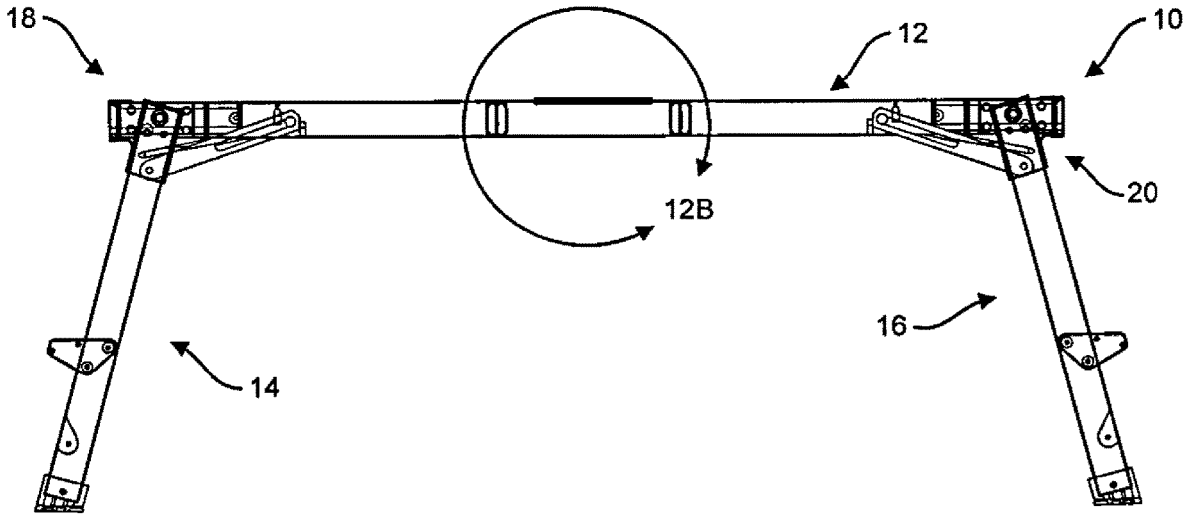
FIG. 12A is a side view of the work scaffold.
Figure 12B:
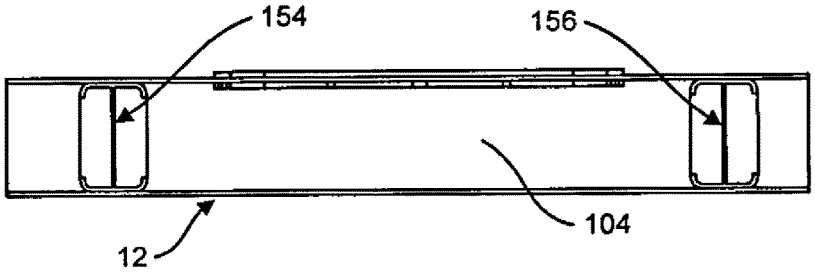
FIG. 12B is a side view of the work scaffold showing the cross members.
Figure 13A:
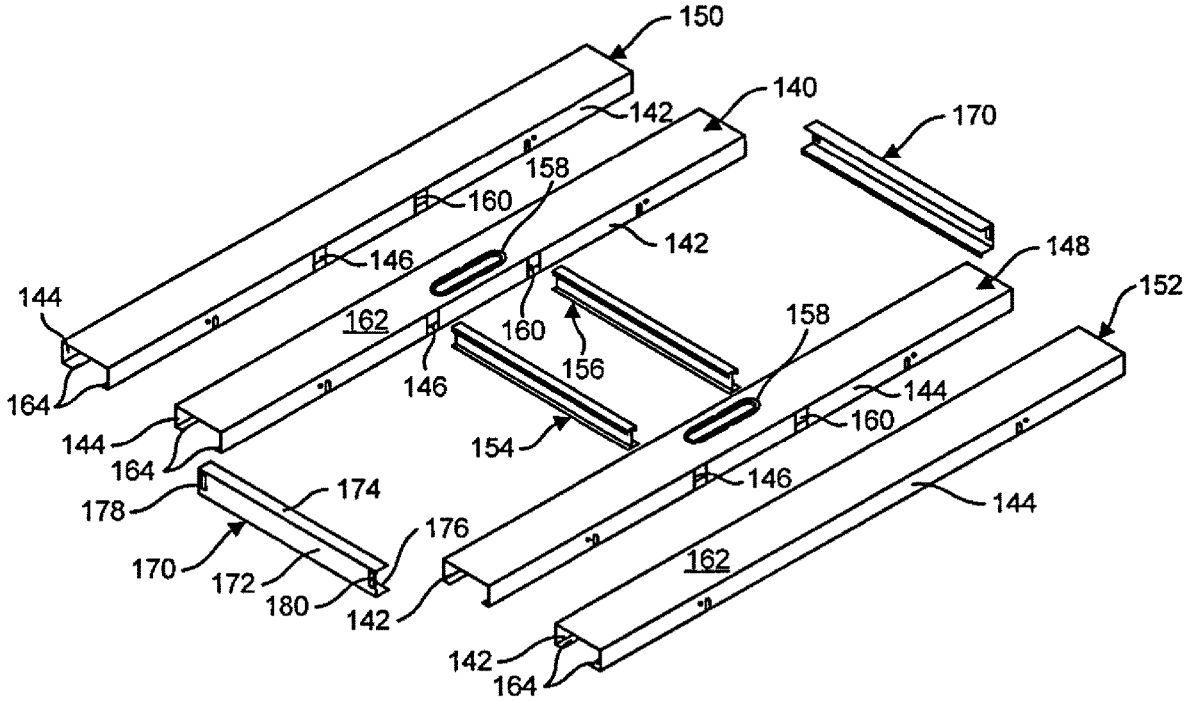
FIG. 13A is an exploded view of the platform.
Figure 13B:
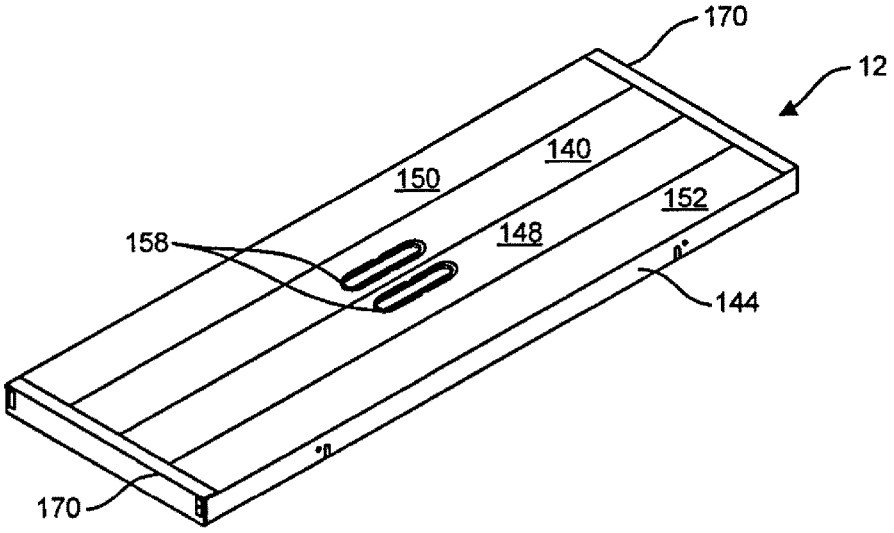
FIG. 13B is a perspective view of the platform.

FIGS. 10*a* and 10*b* show two work scaffolds 10 ganged together. The work scaffold 10 on the right has its hooks extended and engaged in the "empty" hook brackets of the work platform 12 on the left. The perspective detail underside view shows the engagement. Notice that the right end leg assembly of the left work platform 12 is in the folded position. It should also be noted that in order to separate the two ganged work scaffolds of FIG. 10, the left end of the left work scaffold 10 would need to be raised about 30° to disengage from the hooks. This is due to the shape of the hook ends and serves to prevent the work scaffolds from separating unintentionally. The left end must also be raised in order to join the two work scaffolds together.

FIGS. 12*a*, 12*b*, 13*a* and 13*b* show details of the platform 12 construction. Holes are formed in the first and second faces 142, 144 of the inner boards and the first faces of the outer boards to allow for insertion of the cross members. This permits the platform 12 to have a compact height while the cross members add strength to resist bending parallel to the boards without significantly reducing the boards' strength to resist bending parallel to the cross members. The scaffold 10 supports loads of at least 250 lbs. when the scaffold 10 is in the open position, and even 300 lbs. or at least 500 lbs. when in the open position.

FIG. 14A is a front view of the work scaffold 10 with the latch handle 24 down.

FIG. 14B is a side view of a portion of the work scaffold 10 with the latch handle 24 down.

FIG. 15A is a front view of the work scaffold 10 with the latch handle 24 up.

FIG. 15B is a side view of a portion of the scaffold 10 with the latch handle 24 up.

Figures 16A, 16B:
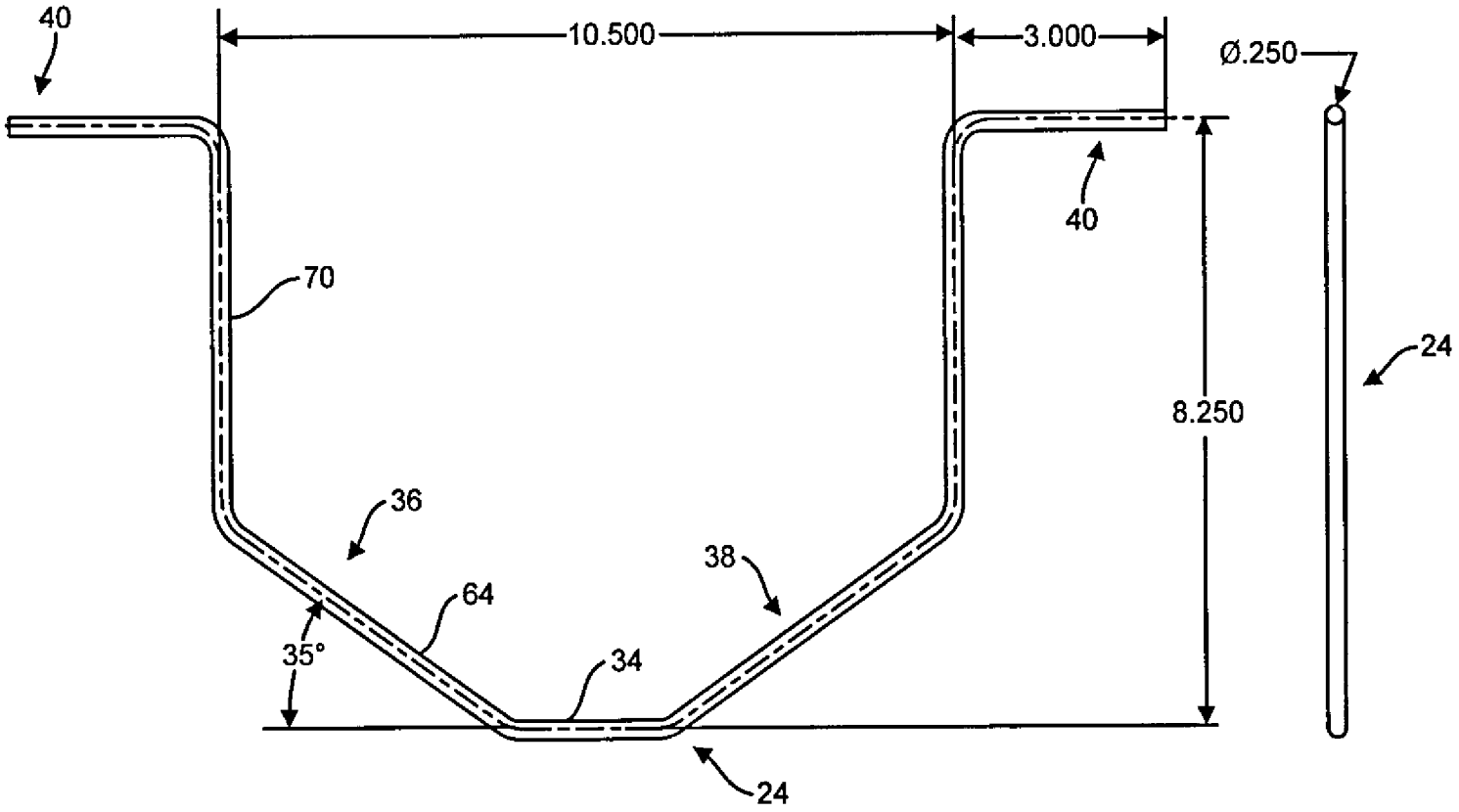
FIG. 16A is an overhead view of the latch handle.
FIG. 16B is a side view of the latch handle.

FIG. 16A is an overhead view of the latch handle 24.

FIG. 16B is a side view of the latch handle 24.

Figure 17:
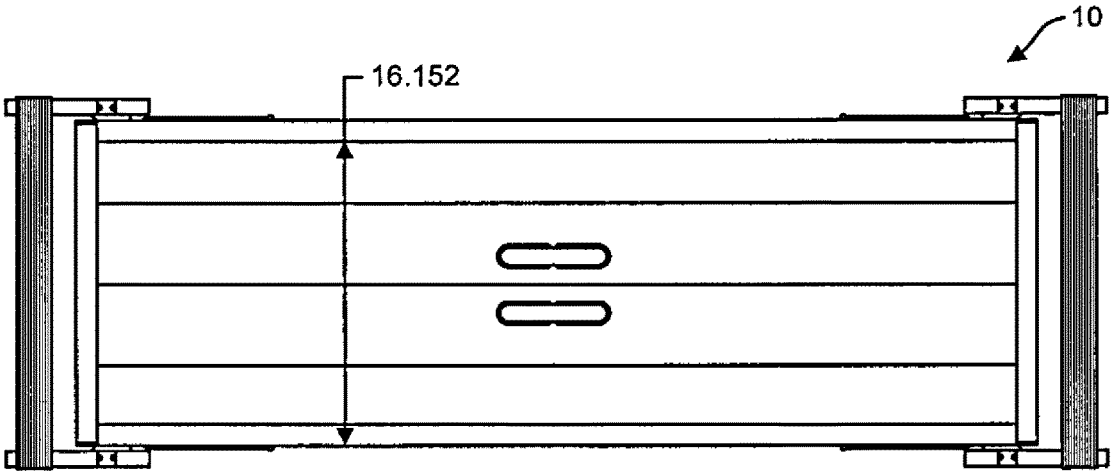
FIG. 17 is an overhead view of the work scaffold.

FIG. 17 is an overhead view of the work scaffold 10.

Figure 18:
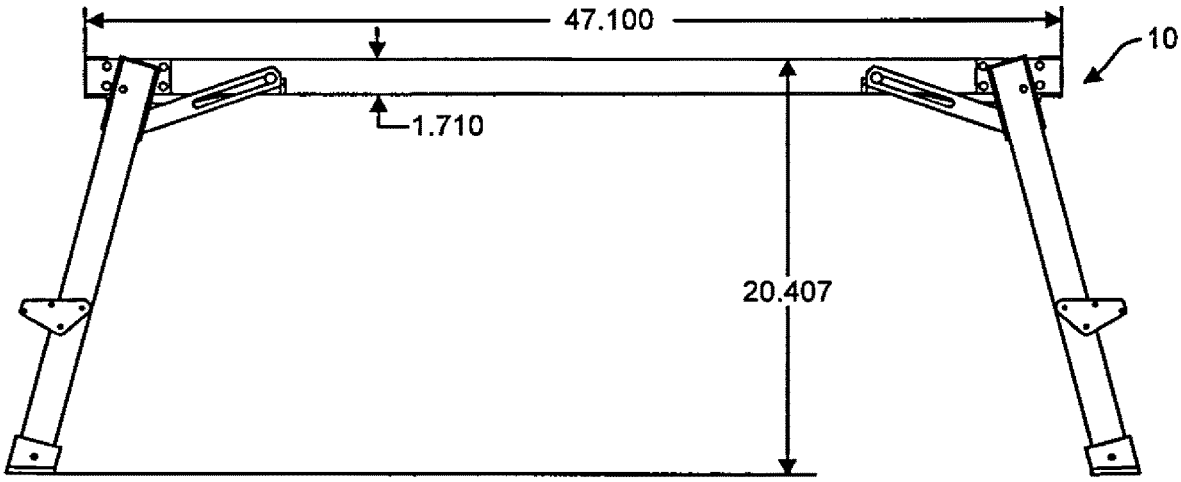
FIG. 18 is a side view of the work scaffold.

FIG. 18 is a side view of the work scaffold 10.

Figure 19:
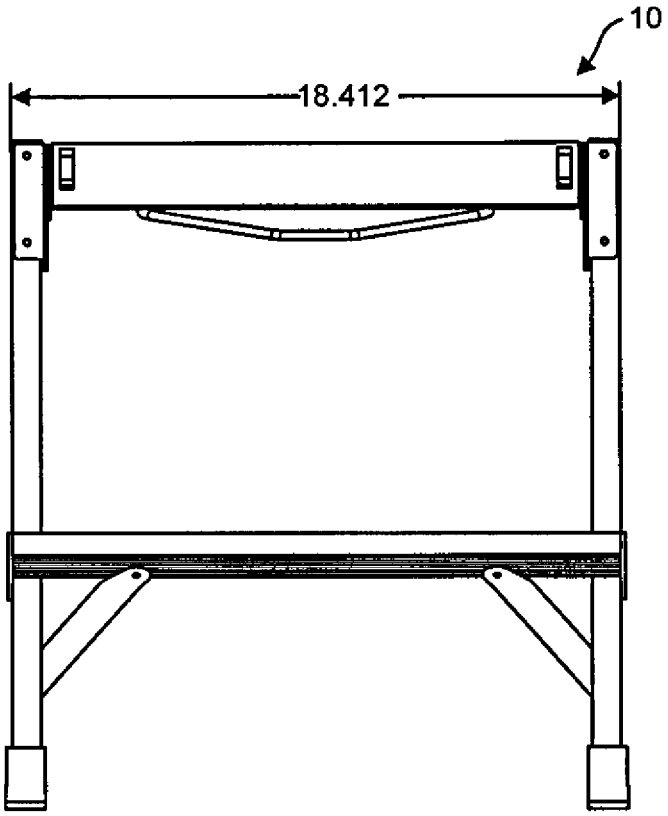
FIG. 19 is a front view of the work scaffold.

FIG. 19 is a front view of the work scaffold 10.

Figure 20:
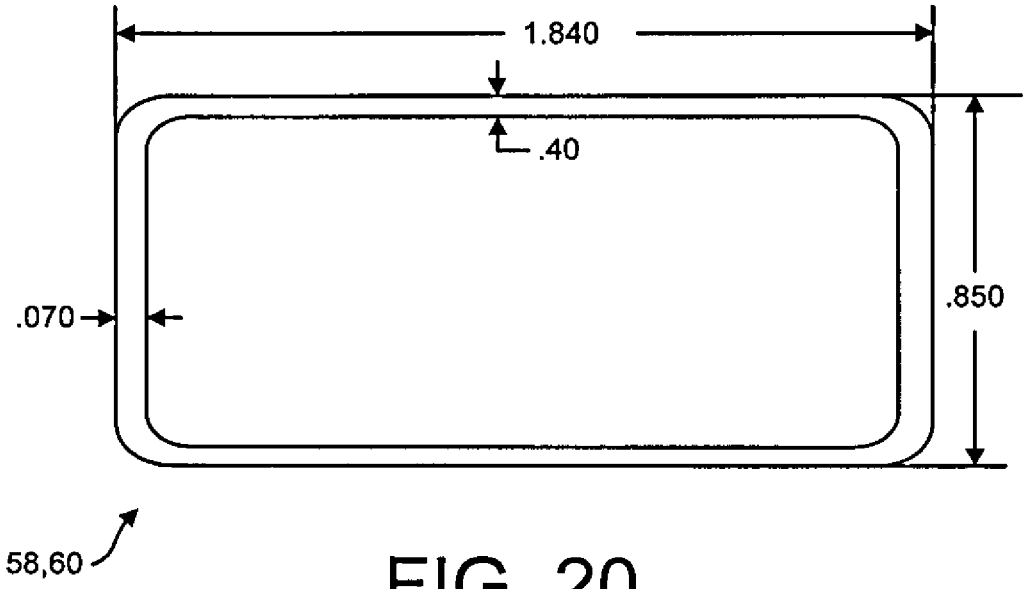
FIG. 20 is a cross-sectional view of the rail.

FIG. 20 is a cross-sectional view of the rail 58.

Figure 21:
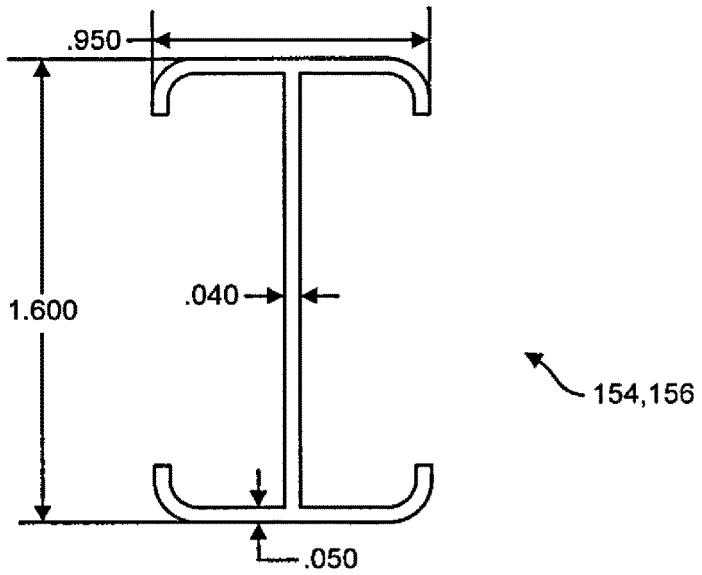
FIG. 21 is a cross-sectional view of the crossmember.

FIG. 21 is a cross-sectional view of the crossmember 154.

Figure 22:
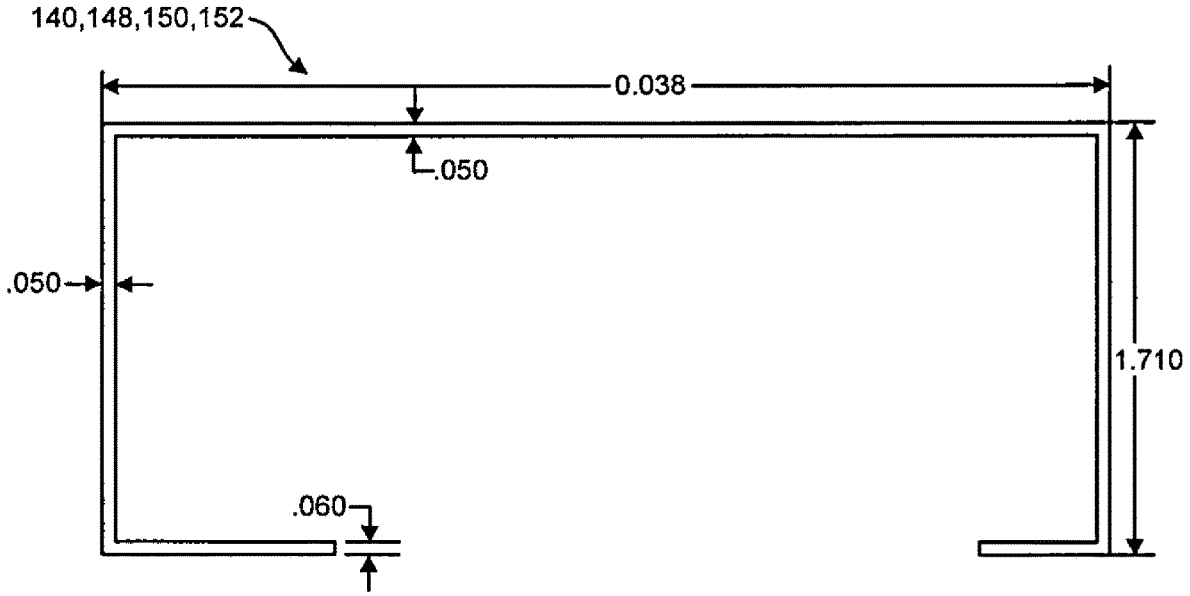
FIG. 22 is a cross-sectional view of the inner and outer boards.

FIG. 22 is a cross-sectional view of the inner and outer boards 140, 148, 150, 152.

Figure 23:
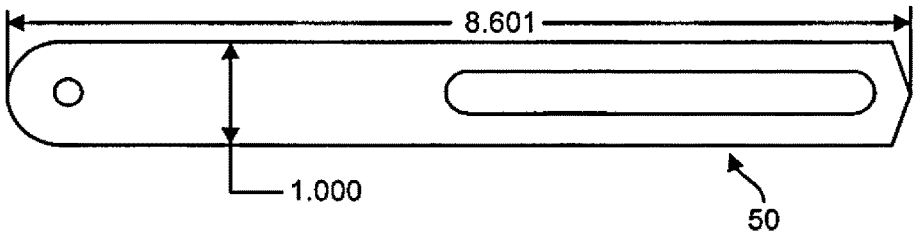
FIG. 23 is an overhead view of the link.

FIG. 23 is an overhead view of the link 50.

Figure 24:
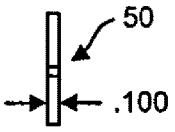
FIG. 24 is a side view of the link.

FIG. 24 is a side view of the link 50.

Figure 25:
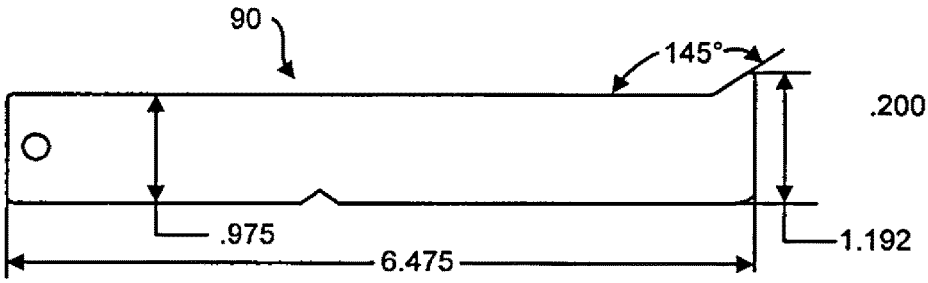
FIG. 25 is an overhead view of the hook.

FIG. 25 is an overhead view of the hook 90.

Figure 26:
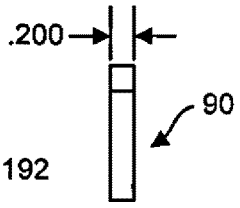
FIG. 26 is a side view of the hook.

FIG. 26 is a side view of the hook 90.

Figure 27:
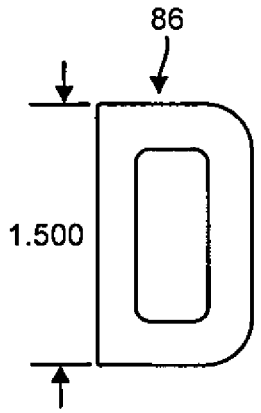
FIG. 27 is a front view of the hook bracket.

FIG. 27 is a front view of the hook bracket 86.

Figure 28:
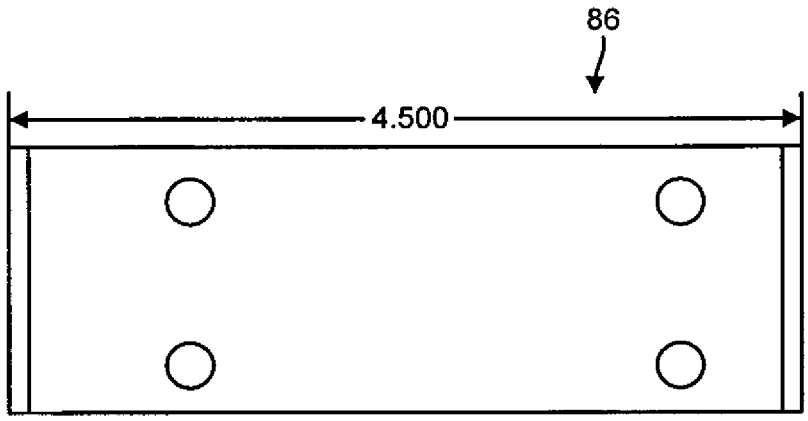
FIG. 28 is an overhead view of the hook bracket.

FIG. 28 is an overhead view of the hook bracket 86.

Figure 29:
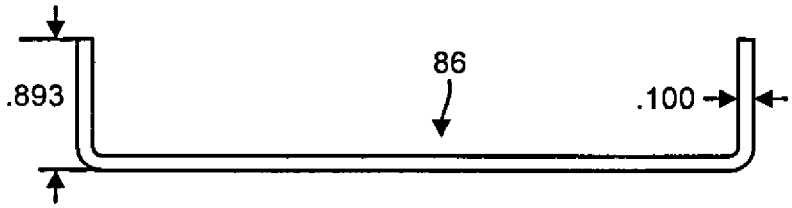
FIG. 29 is a side view of the hook bracket.

FIG. 29 is a side view of the hook bracket 86.

Figure 30:
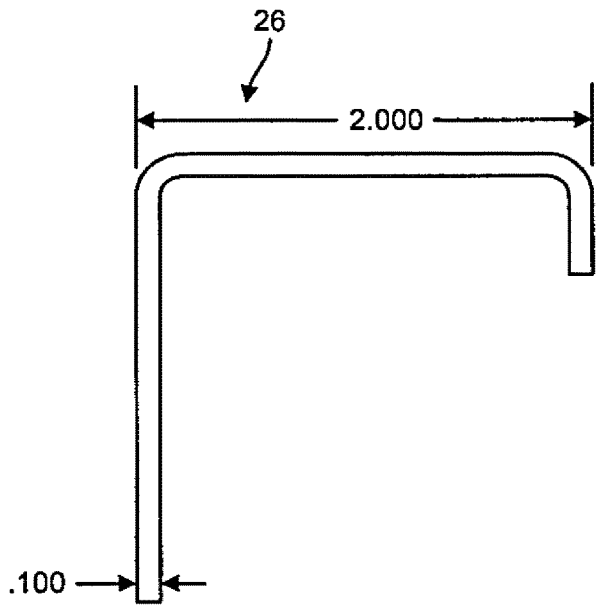
FIG. 30 is a side view of the latch bracket.

FIG. 30 is a side view of the latch bracket 26.

Figure 31:
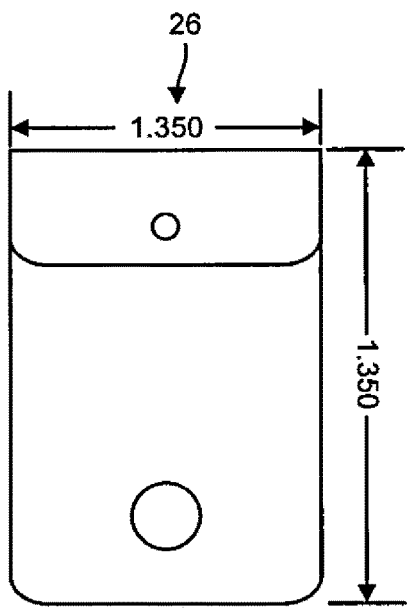
FIG. 31 is a front view of the latch bracket.

FIG. 31 is a front view of the latch bracket 26.

Figure 32:
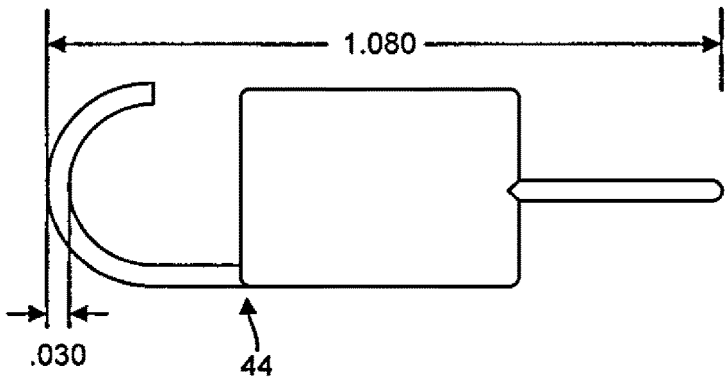
FIG. 32 is an overhead view of the hook spring.

FIG. 32 is an overhead view of the hook spring 98.

Figure 33:
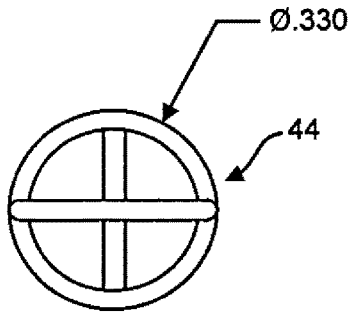
FIG. 33 is a side view of the hook spring.

FIG. 33 is a side view of the hook spring 98.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A work scaffold comprising:

a platform;

a first kg assembly moat lye attached in proximity to a first end of the platform;

a second leg assembly rotatably attached proximity to a second end of the platform; and a latch assembly which locks the first leg assembly in an open position where the first leg assembly forms an angle between 30° and 125° with the platform so a user can be supported on the scaffold when standing on the scaffold, and unlocks the first leg assembly from the locked position so the first leg assembly can rotatably move into a closed position where the first leg assembly is folded up to the platform and is essentially in parallel with the platform, the latch assembly having a latch handle and a first latch bracket attached adjacent a first side of the platform and a second latch bracket attached adjacent a second side of the platform, the latch handle having a generally U shape formed by a center portion and a first arm and a second arm which extend from either side of the center portion, the first arm held to the platform by the first latch bracket and the second arm held to the platform by the second latch bracket, the first arm having a free end which extends through a first platform slot in the first side of the platform, the latch assembly having a first spring which biases the free end towards a top of the first platform slot in the open position, the platform having a first latch bolt extending outwards from the first side, a first link with a link slot, the first link, attached to the front kg assembly with a first latch bolt disposed in the first link slot to hold the first link to the first side of the platform, as the first leg assembly moves relative to the platform, the first link slot moves along the first latch bolt until the first, latch bolt is disposed at a far end of the first link slot when the scaffold is in the open position, and the first latch bolt is disposed at a rear end of the link slot when the scaffold is in the closed position, the free end of the first arm extends out of the first platform slot and blocks the first link from moving and thus locks the first leg assembly in the open position, when the handle is moved up, the first arm moves down in the first platform slot allowing the first link slot to move along the first latch bolt and thus the first link to move to the folded position, when in the folded position, the first link holds down the free end with the first latch bolt disposed in the rear end of the link slot, which holds the handle up towards the platform so the handle will not catch on an object when the scaffold is being moved.

2. The scaffold of claim 1 wherein the first leg assembly has a first rail and a second rail in spaced relation and in parallel with the first rail, and a support bar attached to the first rail and second rail and disposed in front of the first and second rails.

3. The scaffold of claim 2 wherein the first arm has a first segment that extends at a first end of the first segment from a first end of the center portion at an angle between 20° and 55°, a second segment that extends at a first end of the second segment from a second end of the first segment at an angle between 20° and 50°, the free end extending at an angle of about 90° from a second end of the second segment.

4. The scaffold of claim 3 wherein the first and second rails of the first leg assembly are coplanar with the platform in the closed position.

* * * * *